US012397960B2

(12) United States Patent
Couture et al.

(10) Patent No.: US 12,397,960 B2
(45) Date of Patent: Aug. 26, 2025

(54) PRODUCE TRAYS WITH REINFORCED TABS

(71) Applicant: WestRock Shared Services, LLC, Atlanta, GA (US)

(72) Inventors: David G. Couture, Hoschton, GA (US); Michael McLeod, Romeoville, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 18/151,388

(22) Filed: Jan. 6, 2023

(65) Prior Publication Data

US 2024/0228105 A1 Jul. 11, 2024

(51) Int. Cl.

*B65D 5/00* (2006.01)
*B65D 5/22* (2006.01)
*B65D 5/44* (2006.01)

(52) U.S. Cl.

CPC ..... *B65D 5/0045* (2013.01); *B65D 5/22* (2013.01); *B65D 5/443* (2013.01)

(58) Field of Classification Search

CPC ..... B65D 5/0045; B65D 5/22; B65D 5/443; B65D 5/0015; B65D 5/002; B65D 5/42; B65D 5/001

USPC ..... 229/169, 187, 108, 176, 185.1, 919; 206/503, 509, 511, 557

See application file for complete search history.

(56) References Cited

U.S. PATENT DOCUMENTS 3,102,674 A * 9/1963 Hamilton ..... B65D 5/48048 229/187
3,114,493 A * 12/1963 Dunkin ..... B65D 5/22 229/117.17
5,458,283 A 10/1995 Southwell
8,205,787 B2 * 6/2012 Panduro, Jr. ..... B65D 5/6629 229/173
8,827,142 B2 * 9/2014 Smith ..... B31B 50/26 229/199
2002/0179481 A1 12/2002 Noland
2014/0246484 A1 9/2014 Armstrong et al.

FOREIGN PATENT DOCUMENTS

DE 9210936 U1 12/1992
EP 0575004 A1 12/1993

OTHER PUBLICATIONS

International Search Report for PCT/US23/85010 dated Apr. 26, 2021, 5 pages.

* cited by examiner

*Primary Examiner* — Christopher R Demeree
(74) *Attorney, Agent, or Firm* — Neil G. Cohen; Rohini K. Garg

(57) ABSTRACT

In accordance with at least one aspect of this disclosure, a blank for forming a container includes a base having a first pair of opposed base edges and a second pair of opposed base edges. The blank includes two first side wall structures, each first side wall structure foldably attached to one of the first base edges and two second side wall structures, each second side wall structure foldably attached to one of the second base edges.

20 Claims, 20 Drawing Sheets

FIG. 1A

PRODUCE TRAYS WITH REINFORCED TABS

BACKGROUND

1. Field

The present disclosure relates to containers for packaging product such as produce, and more particularly to tab structures that can be used for stacking multiple containers.

2. Description of Related Art

Various designs exist for forming tray-like containers from corrugated paper material. Such containers can be used to hold product such as produce. It can be advantageous to stack multiple filled containers, one on top of the other, to transport the product and/or to save space in a retail setting. Stacking tabs from the containers can be used to interlock stacked containers together.

The conventional techniques have been considered satisfactory for their intended purpose. However, there is an ever present need for improved systems and methods for improved tabs on stackable tray type containers. This disclosure provides a solution for this need.

SUMMARY

In accordance with at least one aspect of this disclosure, a blank for forming a container includes a base having a first pair of opposed base edges and a second pair of opposed base edges. The blank includes two first side wall structures, each first side wall structure foldably attached to one of the first base edges and two second side wall structures, each second side wall structure foldably attached to one of the second base edges. Each of the second side wall structures include a first wall panel foldably attached to one of the second base edges along a first fold line, a second wall panel foldably attached to the first wall panel configured to be overlapped with the first wall panel to form a side wall, a first minor end flap foldably attached to the first wall panel extending in a lateral direction from the first side wall panel, and a second minor end flap foldably attached to the second side wall panel extending in the lateral direction from the second side wall panel, configured to overlap the first minor end flap and one of the first side wall structures in forming a corner of a container formed from the blank.

A stacking tab section is defined in the first and second minor end flaps and is configured to form a stacking tab extending upright from a first side wall of the container formed from the blank with the first and second minor end flaps overlapped with one of the side wall structures to form the first side wall. A first portion of the stacking tab section is formed in the first minor end flap and a second portion of the stacking tab section is formed in the second minor end flap. A cut separates the first and second portions of the stacking tab section, so the first and second portions of the stacking tab section can separate to facilitate erecting the container made from the blank. The first and second wall panels are configured to fold along a fold line to overlap the first and second wall panels with one another to form the first wall panel to form a side wall.

In embodiments, the first and second wall panels can be configured to form a first end wall adjacent to the to the first side wall with the corner of the container connecting between the first end wall and the first side wall.

In certain embodiments, the stacking tab section can be a first stacking tab section. A first portion of a second stacking tab section can be defined on the first wall panel and a second portion of the second stacking tab section can be defined on the second wall panel where the fold line can connect the first and second portions of the second stacking tab section. The second stacking tab section can be configured to form a second stacking tab extending upward from the first end wall of the container formed from the blank.

In certain embodiments, a void can separate the first and second wall panels so that in the container formed from the blank, the fold line is configured to form a top edge of the second stacking tab, relative to the base. One or more edges of the void can form top edges of the first end wall and of the first side wall below the top edge of the second stacking tab, relative to the base.

In certain embodiments, the first minor end flap can include a first corner panel and the second minor end flap can include a second corner panel. The first and second corner panels can be configured to overlap and form a beveled wall connecting the first end wall to the first side wall in the container formed from the blank.

In certain embodiments, the first and second minor end flaps can be long enough meet opposing first and second minor end flaps at a midpoint of the base in the container formed from the blank. The first stacking tab section can be configured to form a single stacking tab in cooperation with an opposing stacking tab section of the opposing first and second minor end flaps.

In certain embodiments, the first and second minor end flaps are not long enough meet opposing first and second minor end flaps at a midpoint of the base in the container formed from the blank. The first stacking tab section can be configured to form a separate stacking tab from an opposing stacking tab section of the opposing first and second minor end flaps.

In certain embodiments, a first portion of a third stacking tab section can be defined on the first wall panel and a second portion of the third stacking tab section can be defined on the second wall panel. The fold line can connect the first and second portions of the third stacking tab section and the third stacking tab section can be configured to form a third stacking tab extending upward from the first end wall of the container formed from the blank.

In certain embodiments, the base can define an anti-nesting corner configured to extend outside the first end wall and the first side wall in the container formed from the blank.

In certain embodiments, the first minor end flap can be foldably connected directly to the first wall panel, and the second minor end flap can be foldably connected directly to the second wall panel so that in the container formed from the blank, the first end wall is foldably connected directly to the first side wall without an intervening bevel panel.

In certain embodiments, the first and second minor end flaps can be long enough meet opposing first and second minor end flaps at a midpoint of the base in the container formed from the blank. The first stacking tab section can be configured to form a single stacking tab in cooperation with an opposing stacking tab section of the opposing first and second minor end flaps.

In certain embodiments, the first and second minor end flaps are not long enough meet opposing first and second minor end flaps at a midpoint of the base in the container formed from the blank. The first stacking tab section can be configured to form a separate stacking tab from an opposing stacking tab section of the opposing first and second minor end flaps.

In certain embodiments, a first portion of a third stacking tab section can be defined on the first wall panel and a second portion of the third stacking tab section can be defined on the second wall panel. The fold line can connect the first and second portions of the third stacking tab section and the third stacking tab section can be configured to form a third stacking tab extending upward from the first end wall of the container formed from the blank.

In accordance with at least aspect of this disclosure, a container can be made from a blank as described herein above, where each of the first side wall structures can be positioned inward from the first and second wall panels.

In accordance with at least aspect of this disclosure, a container can be made from a blank as described herein above, where each of the first sidewall structures can be positioned between first and second minor end flaps of the second sidewall structures.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1A:
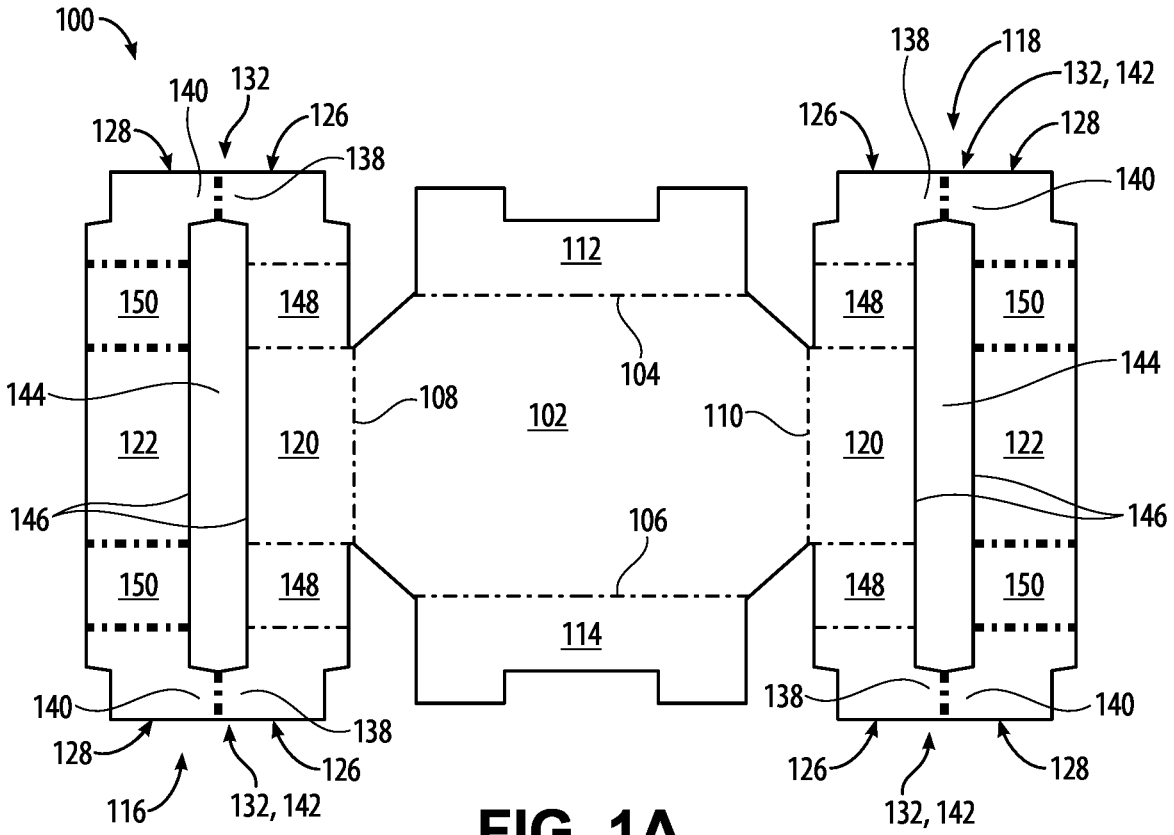
FIG. 1A is a plan view of an embodiment of a blank constructed in accordance with the present disclosure, showing stacking tab portions for forming stacking tabs in a container.

Reference will now be made to the drawings wherein like reference numerals identify similar structural features or aspects of the subject disclosure. For purposes of explanation and illustration, and not limitation, a partial view of an embodiment of a blank in accordance with the disclosure is shown in FIGS. 1A and 1*s* designated generally by reference character 100. Other embodiments of systems in accordance with the disclosure, or aspects thereof, are provided in FIGS. 1B-22, as will be described. The systems and methods described herein can be used to provide blanks to make stackable containers with stacking tabs for containing product such as produce. Blanks as disclosed herein can be configured to be erected into containers by machine or manually or both.

The blank 100 for forming a stackable container 101 (shown in FIG. 1B) includes a base 102 having a first pair of opposed base edges 104, 106 and a second pair of opposed base edges 108, 110. Two first sidewall structures 112, 114 are each foldably attached to one of the first base edges 104, 106, respectively. Two second sidewall structures 116, 118 are each foldably attached to one of the second base edges 108, 110, respectively.

Each of the second sidewall structures 116, 118 includes a first wall panel 120 foldably attached to one of the second base edges 108, 110 along a first fold line, which lies along its respective base edge 108, 110. A respective second wall panel 122 is foldably attached to each first wall panel 120 configured to be overlapped with the respective first wall panel 120 to form a respective side wall 124 (labeled in FIG. 1B).

A respective first minor end flap 126 is foldably attached to each end of each of the first wall panels 120 (for a total of four minor end flaps 126) extending in a lateral direction from its respective first side wall panel 120. A second minor end flap 128 is foldably attached to each end of each of the second side wall panels 122, extending in the lateral direction from its respective second side wall panel 122. There are at total of four minor end flaps 126 and four minor end flaps 128. The minor end flaps 128 are configured to overlap the first minor end flaps 126, respectively, and a proximate one of the first sidewall structures 112, 114 in forming a corner 130 (labeled in FIG. 1B) of a container 101 formed from the blank 100.

Figure 1B:
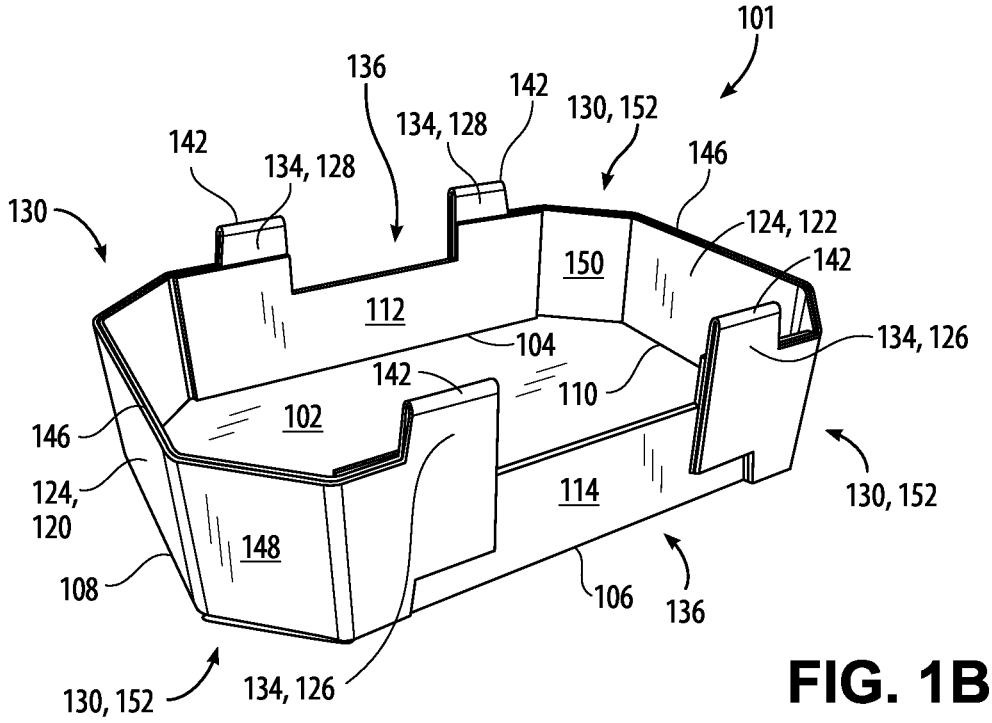
FIG. 1B is a perspective view of a container constructed from the blank of FIG. 1A, showing the stacking tabs.

A stacking tab section 132 is defined in the first and second minor end flaps 126, 126 that is configured to form a stacking tab 134, shown in FIG. 1B extending upright from a first side wall 136 of the container 10,1 formed from the blank 100 with the first and second minor end flaps 126, 128 overlapped with one of the side wall structures 112, 114 to form the first side wall 136. To form the container 101 of FIG. 1B from the blank of FIG. 1A, the second sidewall structures 116, 118 are both folded upright along their respective base edges 108, 110, then the second side wall panels 122 are folded downward into overlapping position with the first side wall panels 120 to form the sidewalls 124 on either end of the container, which puts the second side wall panels 122 on the inside of the container 101. The first sidewall structures 112, 114 are folded upright along their respective base edges 104, 106. Then the minor end flaps 126, 128, which are already overlapped with one another at each respective corner 130, are folded and adhered against their adjacent sidewall structure 112, 114.

This process of erecting the container 101 can be performed manually, or by machine, and those skilled in the art will readily appreciate that any suitable variation in the steps above can be used without departing from the scope of this disclosure. The fold lines in FIG. 1A are indicated with broken lines, and the thicker broken lines indicate crush lines, wider than normal fold lines, that facilitate forming the blank 100 into the container 100, e.g. if the blank 100 is of a corrugated paper material or the like. Similar fold and crush line markings are used throughout the Figures.

With continued reference to FIGS. 1A and 1B, the first and second wall panels are configured to form a first 124 adjacent to the first side walls 136 with each corner 130 of the container 101 connecting between adjacent end walls 124 and side wall 136. A first portion 138 of each stacking tab section 132 is formed in the respective first minor end flap 126. A second portion 140 of the stacking tab section 132 is formed in the second minor end flap 128. A fold line 142 connects the first and second portions 138, 140 of each stacking tab section 132. The first and second wall panels 120, 122 are configured to fold along the fold line, 142 to overlap the first and second wall panels 120, 122 with one another to form each first wall panel to form side walls, specifically the end walls 124.

A void 144, labeled in FIG. 1A, separates the first and second wall panels 120, 122 in each second sidewall structure 116, 118 so that in the container 101 of FIG. 1B, the fold line 142 is on a top edge of each of the stacking tabs 134 formed from the stacking tab sections 132, relative to the base 102, i.e. as oriented in FIG. 1B. Edges 146 of the void 144 form top edges of the end walls 124 and of the side walls 136 below the top edge of the stacking tabs 134, relative to the base. The second side wall structures 116, 118 of FIG. 1A are configured so that there is no stacking tab 134 extending upward from the end walls 124 in the container 100 of FIG. 1B.

With continued reference to FIGS. 1A and 1B, each first minor end flap 126 includes a first corner panel 148. Each second minor end flap 128 includes a second corner panel 150, wherein the pairs of first and second corner panels 148, 150 are each configured to overlap and form a beveled wall 152 connecting the first end walls 124 to the first side walls 136 in the container 101 of FIG. 1B.

Figure 2A:
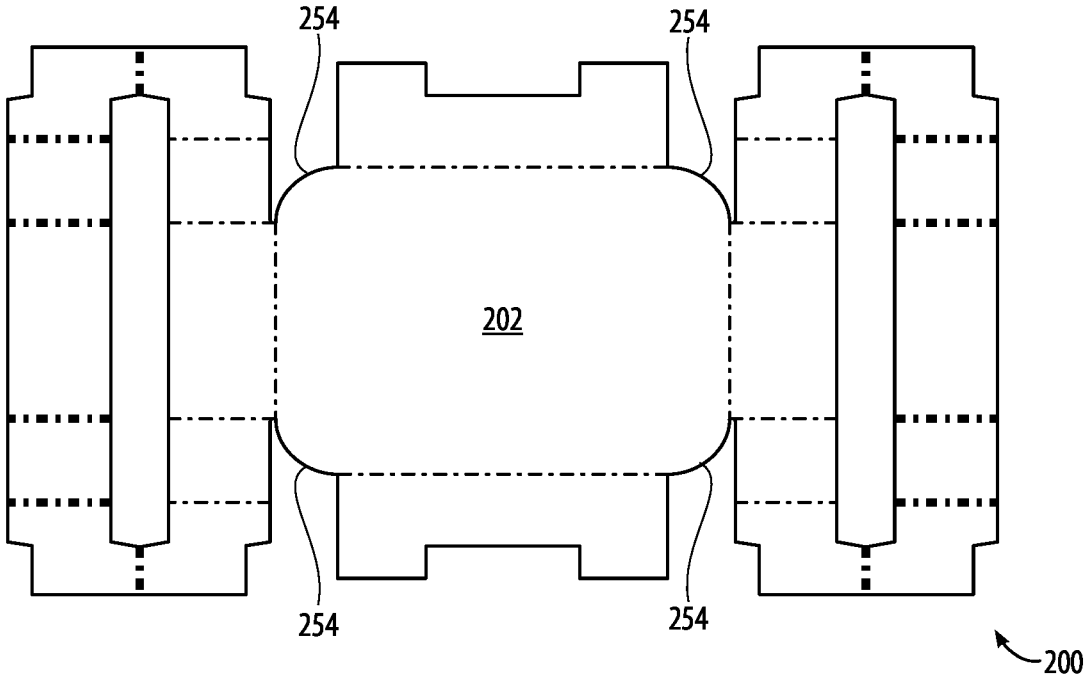
FIG. 2A is a plan view of an embodiment of a blank constructed in accordance with the present disclosure, showing anti-nesting features.
Figure 2B:
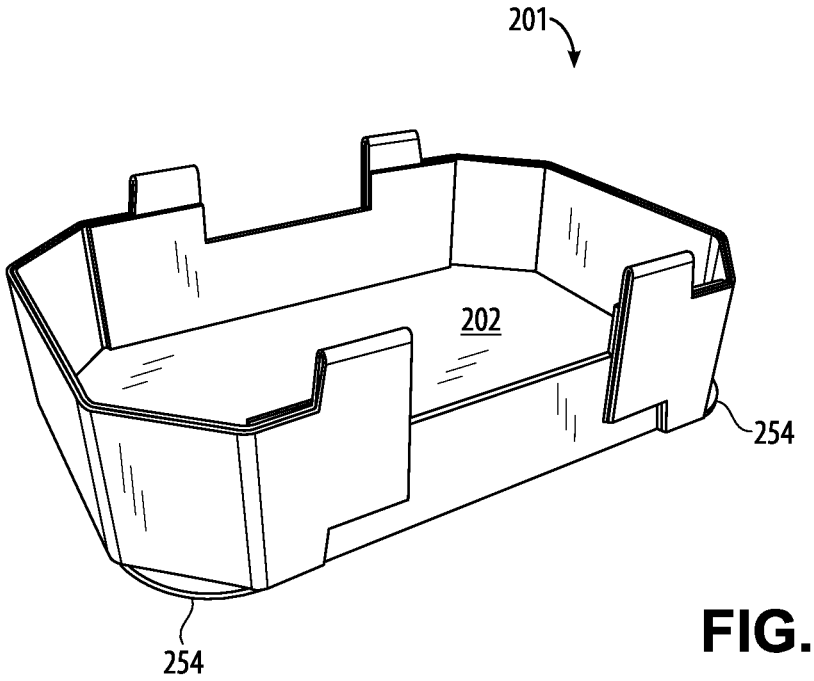
FIG. 2B is a perspective view of a container constructed from the blank of FIG. 2A, showing the anti-nesting features.

FIGS. 2A and 2B show a similar blank 200 and corresponding container 201 to those shown in FIGS. 1A and 1B.

However, the base 202 of the blank 200 and container 201 incudes anti-nesting features 254 in its corners. These anti-nesting features 254 are optional and can make it easier to keep the containers 201 from nesting down into one another when stacking them together, e.g. when full of product.

Figure 3A:
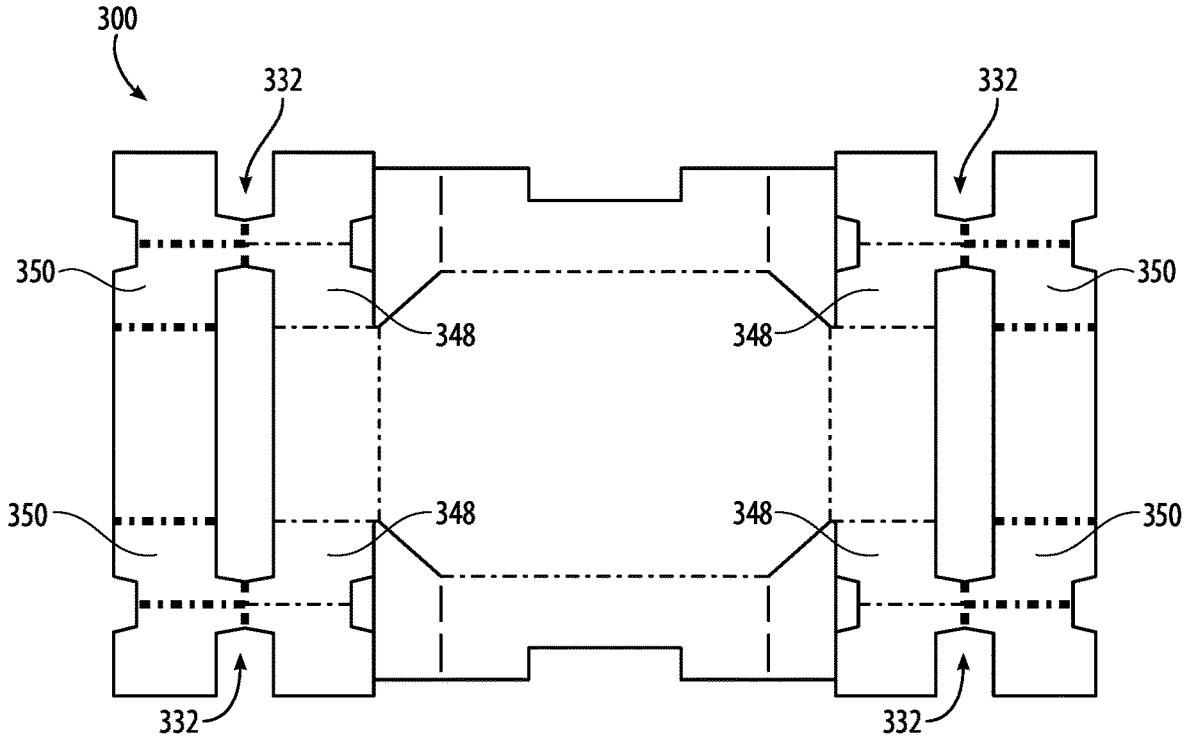
FIG. 3A is a plan view of an embodiment of a blank constructed in accordance with the present disclosure, showing stacking tab features on corner folds.
Figure 3B:
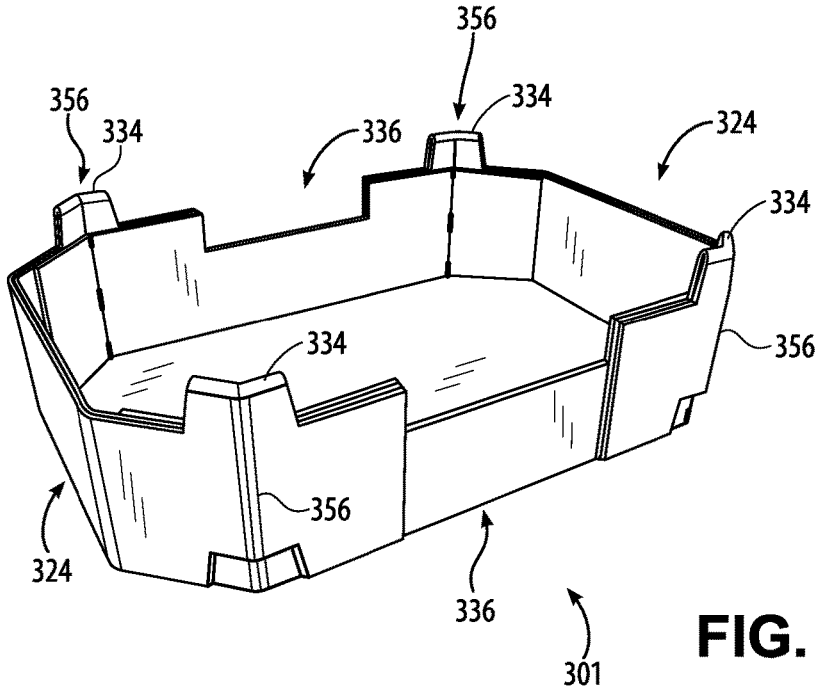
FIG. 3B is a perspective view of a container constructed from the blank of FIG. 3A, showing the stacking tabs on the corner folds.

With reference now to FIGS. 3A and 3B, another blank 300 and corresponding container 301 are shown similar to those in FIGS. 1A and 1B. However, a portion each of the stacking tab sections 332 is formed in the first and second corner panels 348, 350. The result is that in the container 301 formed from the blank 300, the stacking tab sections 332 forms stacking tabs 334 extending along both sides of a fold line 356 connecting the first sidewalls 336 and the first end wall 324.

Figure 4A:
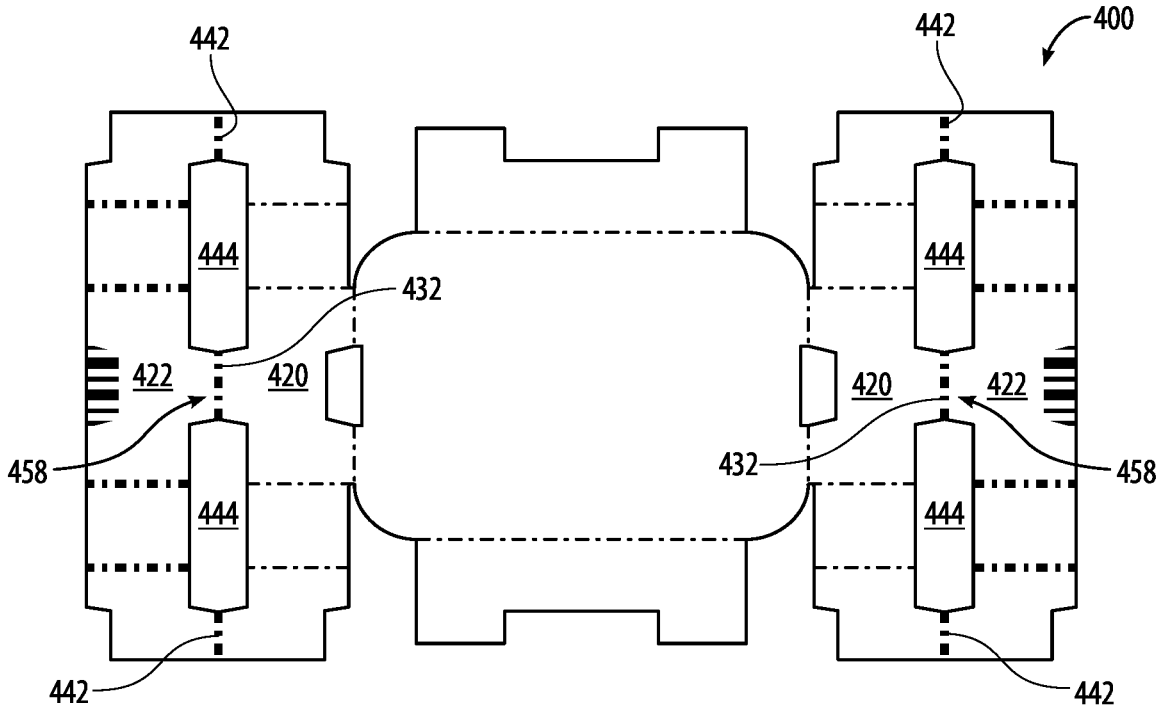
FIG. 4A is a plan view of an embodiment of a blank constructed in accordance with the present disclosure, showing stacking tab portions for end tabs.
Figure 4B:
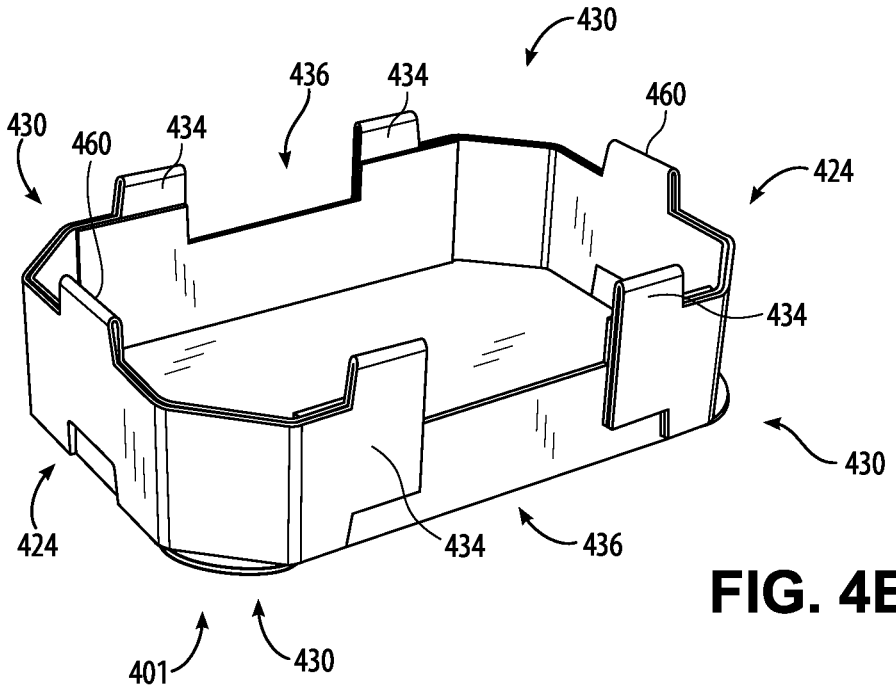
FIG. 4B is a perspective view of a container constructed from the blank of FIG. 4A, showing the end tabs.

With reference now to FIGS. 4A and 4B, another blank 400 container 401 are shown that are similar to those in FIGS. 1A and 1B. However, additional stacking tab sections 458 defined in the first and second wall panels 420, 422, configured to form a stacking tab, i.e. end tabs 460, extending upright from the end walls 424 of the container 401 formed from the blank 400. The corners 460 of the container 400 connect between the end walls 424 and the side wall 436. The end tabs 460 are in addition to the stacking tabs 434 that are similar to those described above for FIGS. 1A and 1B, so there are a total of six stacking tabs 434, 460 on the container 401.

The first and second stacking tab portions (not numbered in FIG. 4A to avoid obscuring the Figure, but see reference character 132 in FIG. 1A) each fold along the fold line 442. The fold line 442 is interrupted between the first and second stacking tab portions by the voids 444, which are similar to the voids 144 in FIG. 1A, but the stacking tab sections 458 interrupt the voids 444 making for a total of four voids 444.

Figure 5A:
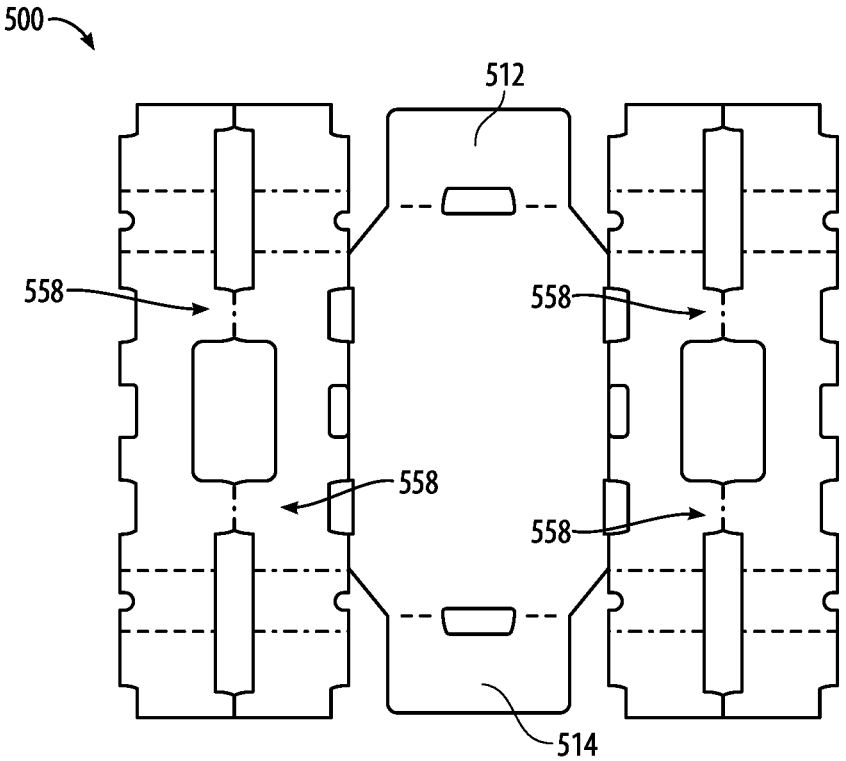
FIG. 5A is a plan view of an embodiment of a blank constructed in accordance with the present disclosure, showing stacking tab portions for additional end tabs.
Figure 5B:
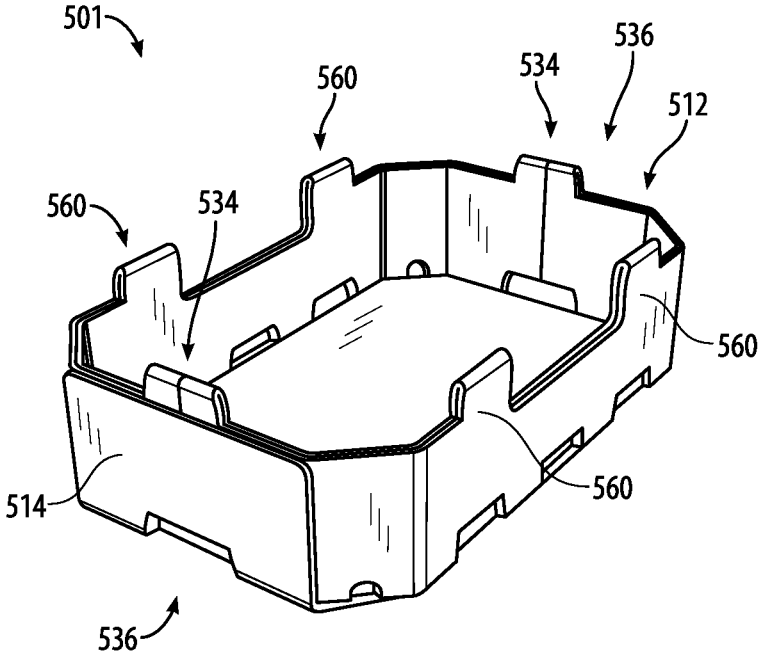
FIG. 5B is a perspective view of a container constructed from the blank of FIG. 5A, showing the additional end tabs.

With reference now to FIGS. 5A and 5B, another blank 500 is shown for forming another octagonal container 501 much as the octagonal containers 101, 201, 301, 401 described above. However, the minor end flaps (see reference characters 126, 128 in FIG. 1A) are made long enough to merge the two stacking tabs 534 on each side wall 536 into a single stacking tab 534 so there are only two stacking tabs 534 on each side wall, as opposed to the four stacking tabs 434 in FIG. 4B. In addition, the blank 500 includes two additional stacking tab portions 558 for a total of four end tabs 560 in the container 501, as opposed to the two end tabs 460 of FIG. 4B. The container 501 has a total of six stacking tabs 534, 560. Also note that the folding order for the container 501 is changed from the foregoing containers 101, 201, 301, 401 so that the first sidewall structures 512, 514 are folded up last and adhered to the outer surface of the minor end flaps (not numbered in FIGS. 5A and 5B, but see reference characters 126 in FIGS. 1A and 1B) rather than on the inside of the container 500. It is, however, possible to form the container 500 with the first sidewall structures 512, 514 on the inside of the container 500 as shown, e.g. in FIG. 1B.

Figure 6A:
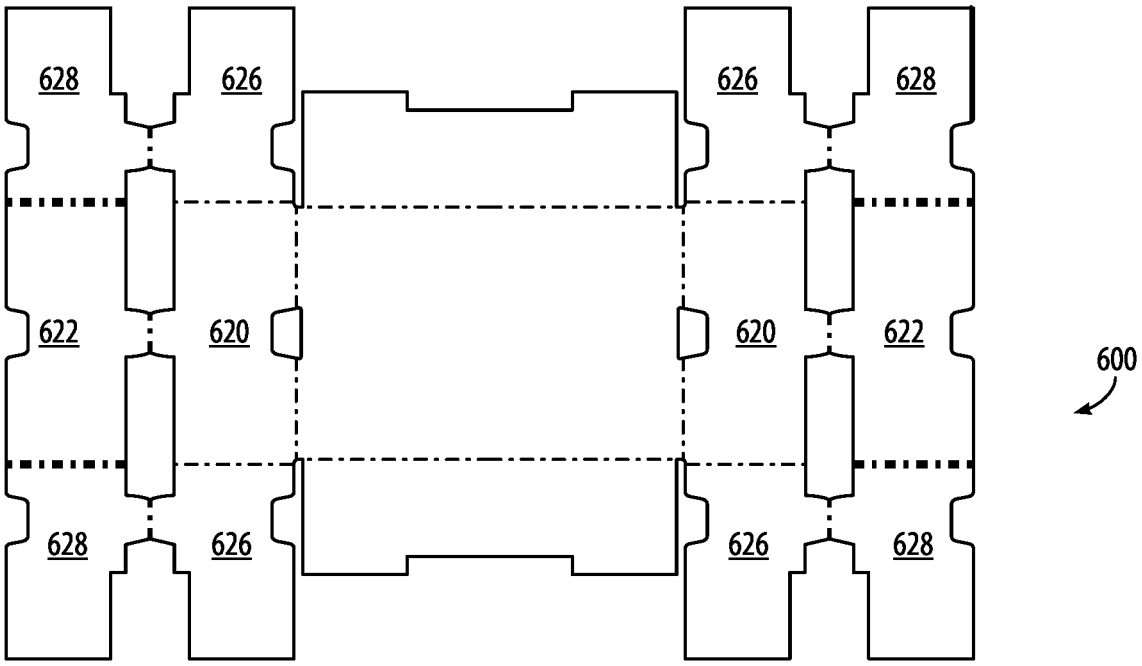
FIG. 6A is a plan view of an embodiment of a blank constructed in accordance with the present disclosure, showing a rectangular base for forming a rectangular container.
Figure 6B:
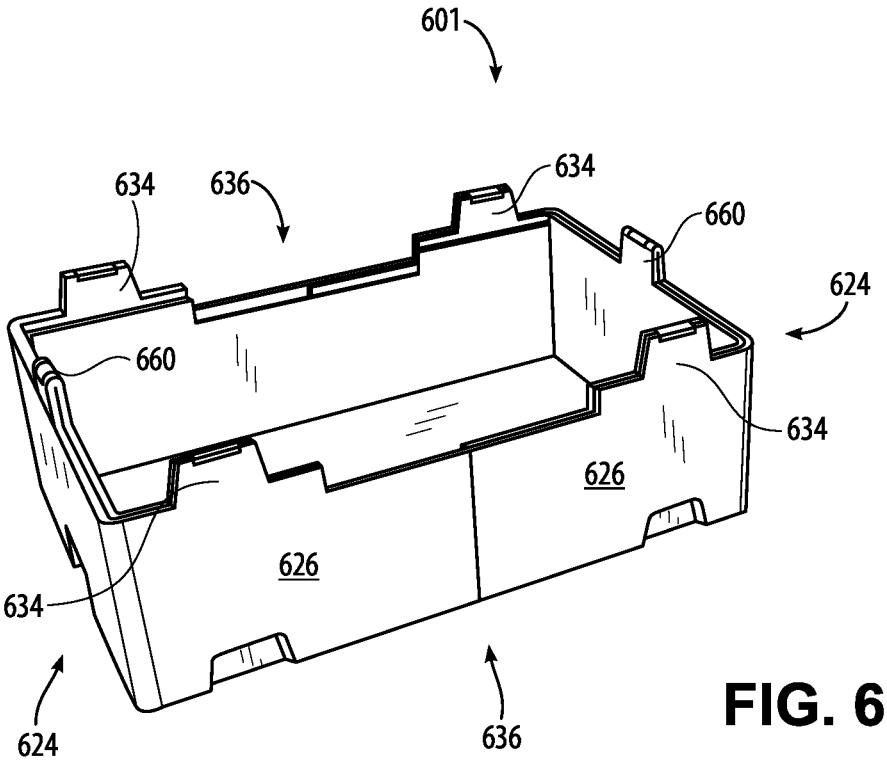
FIG. 6B is a perspective view of a container constructed from the blank of FIG. 6A, showing the wall panels in a rectangular configuration around the base.

With reference now to FIGS. 6A and 6B, there is shown a blank 600 and corresponding container 601 similar to that shown in FIGS. 4A and 4B. However, unlike the foregoing octagonal containers 100, 200, 300, 400, 500, the container 600 is rectangular. The first minor end flaps 626 are each foldably connected directly to the respective first wall panels 620. The second minor end flaps 628 are each foldably connected directly to the respective second wall panels 622 so that in the container 601 formed from the blank 600, the end walls 624 are foldably connected directly to the side walls 363 without an intervening bevel panel such as the panels 148, 150 in FIGS. 1A and 1B. The minor end flaps 626 and 628 are long enough to meet each other in the middle of the sidewalls 636, covering the first sidewall structures 612, 614 which are on the inside of the container 601. However, the minor end flaps 626 and 628 could be made shorter to expose the outward facing surface of the first sidewall structures 612, 614, as in FIGS. 1B and 4B. The stacking tabs 634 and 660 are configured similar to those in FIG. 4B.

Figure 7A:
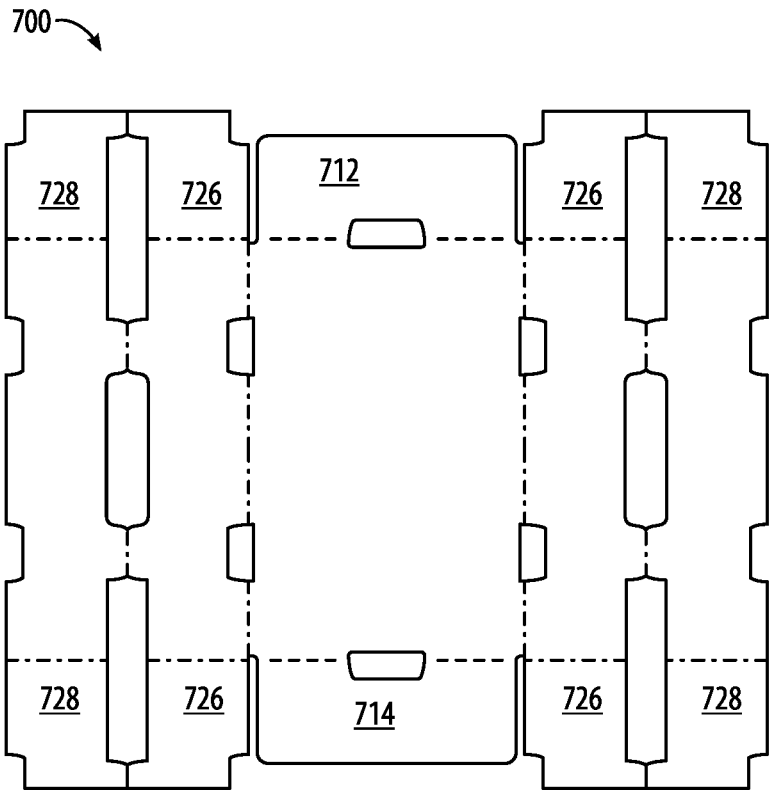
FIG. 7A is a plan view of an embodiment of a blank constructed in accordance with the present disclosure, showing the first sidewall structures configured to be nested between the minor end flaps.
Figure 7B:
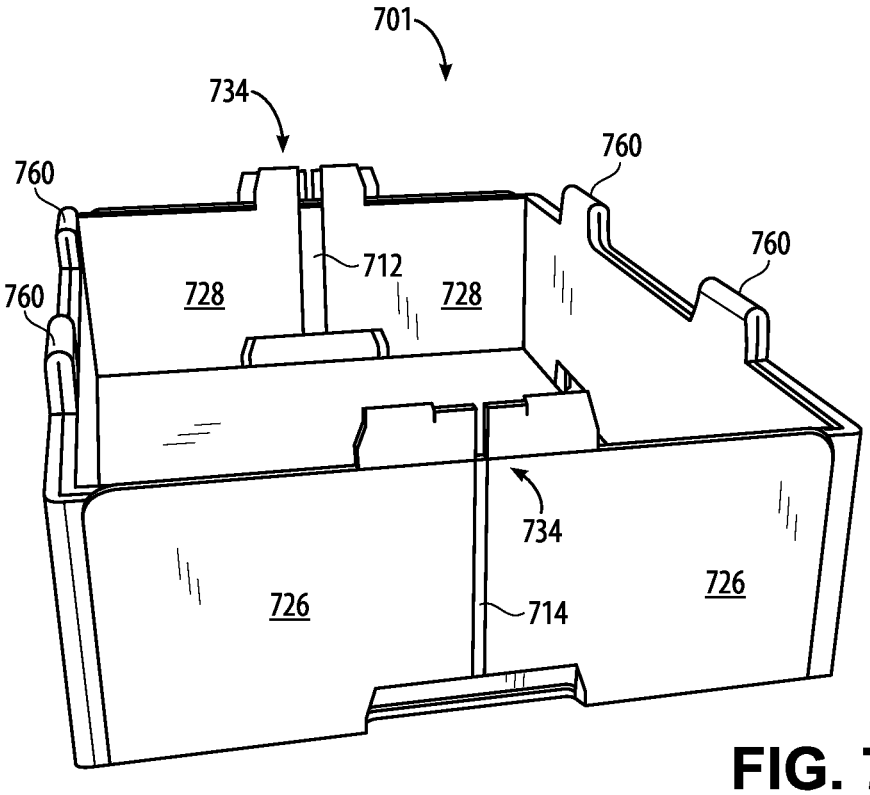
FIG. 7B is a perspective view of a container constructed from the blank of FIG. 7A, showing the first sidewall structures nested between the minor end flaps.
Figure 8:
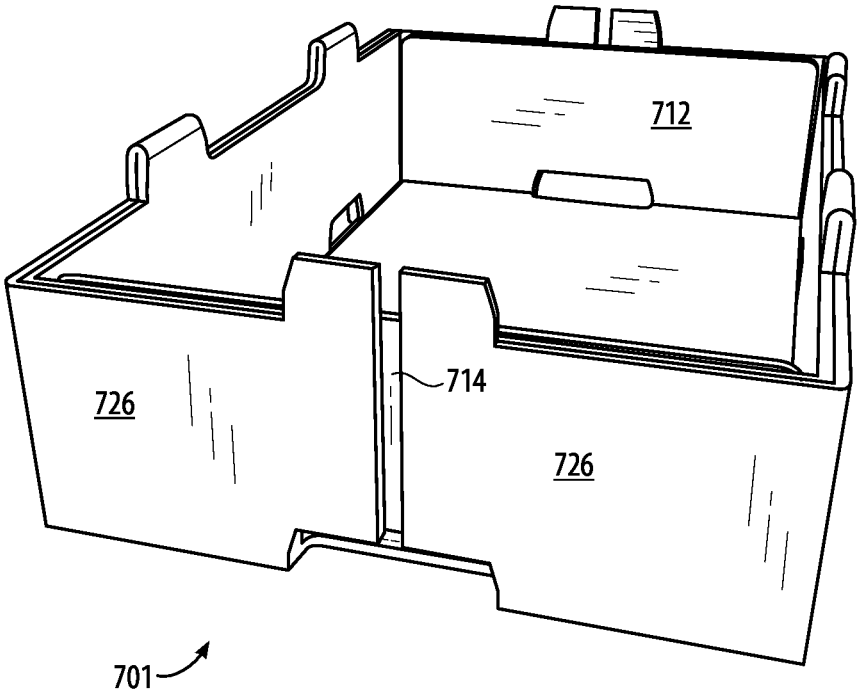
FIG. 8 is a perspective view of a container constructed from a blank similar to that in FIG. 7A, but with the first sidewall structures fully inward from the minor end flaps.
Figure 9:
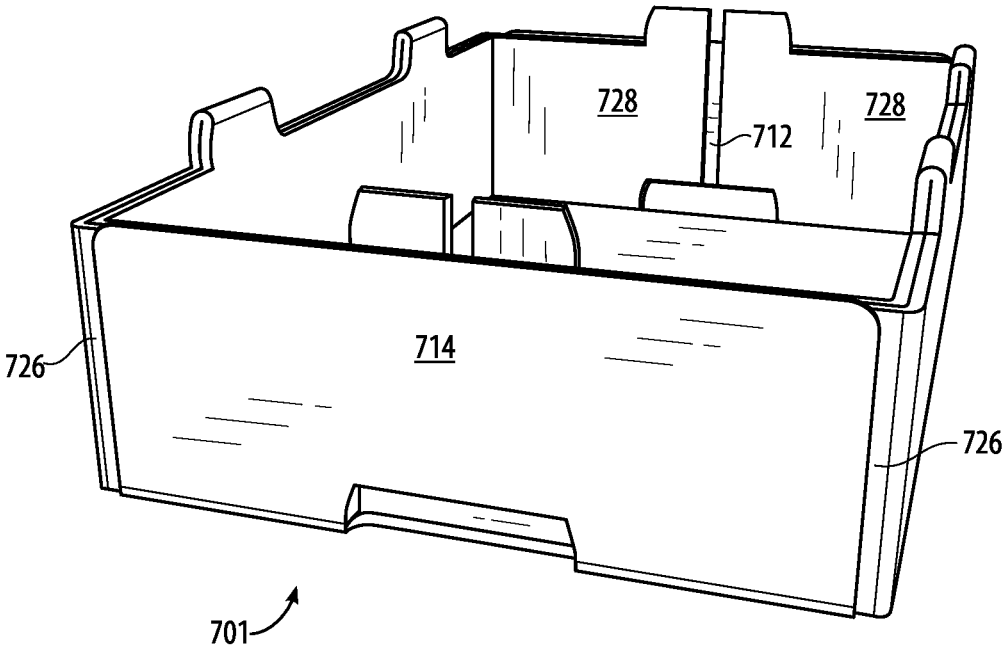
FIG. 9 is a perspective view of a container constructed from a blank similar to that in FIG. 7A, but with the first sidewall structures fully outward from the minor end flaps.

With reference now to FIGS. 7A and 7B, there is shown a blank 700 and corresponding rectangular container 701 similar to that shown in FIGS. 6A and 6B, but with a configuration of stacking tabs 736, 760 similar to that in FIGS. 5A and 5B. Each of the first sidewall structures 712, 714 is positioned inward of first minor end flaps 726 and outward of second minor end flaps 728. However, it is also possible to form the container 701 with the first sidewall structures 712, 714 on the inside of the container 701, inward of the first and second minor end flaps 726, 728 as shown in FIG. 8, fully outside of the first and second minor end flaps 726, 728 as shown in FIG. 9.

In the foregoing containers and blanks, the first and second wall panels fold on fold lines, e.g. fold lines 142 in FIGS. 1A and 1B, that form the top edges of the stacking tabs, e.g. stacking tabs 134 of FIG. 1B. Now, with reference to FIGS. 10A through 14B, there are blanks 1000, 1100, 1200, 1300, 1400 and their containers 1001, 1101, 1201, 1301, 1401, with a different folding configuration.

Figure 10A:
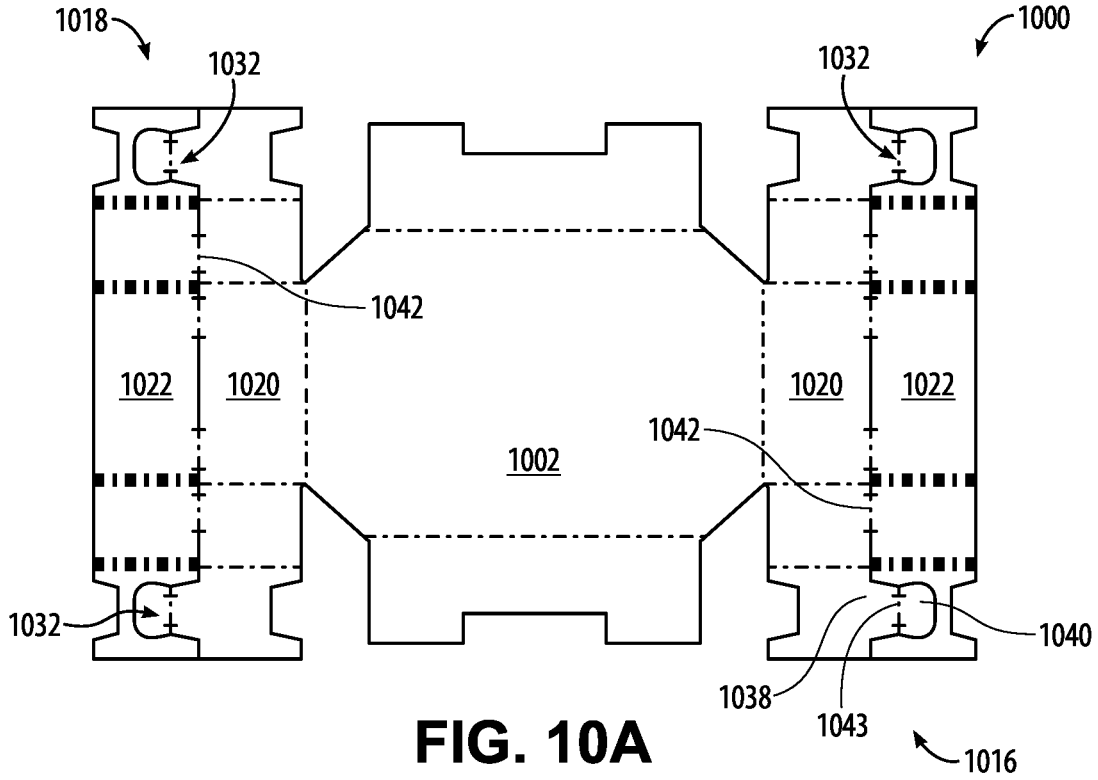
FIG. 10A is a plan view of an embodiment of a blank constructed in accordance with the present disclosure, showing fold lines along which the first and second wall panels are directly connected.
Figure 10B:
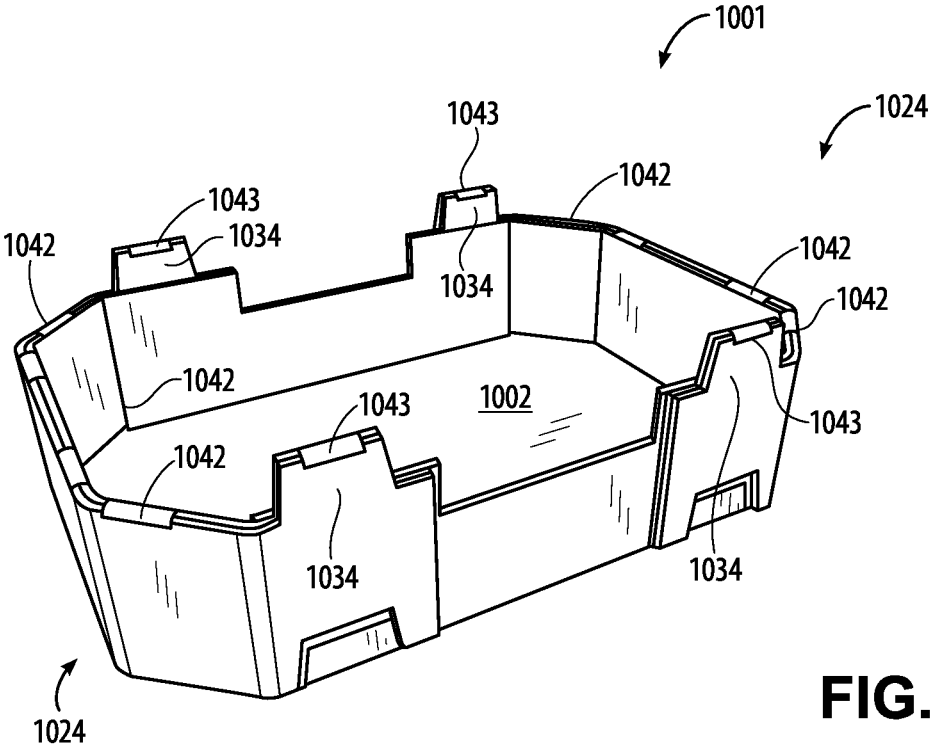
FIG. 10B is a perspective view of a container constructed from the blank of FIG. 10A, showing the stacking tabs.

With reference now to FIGS. 10A and 10B, there is a blank 1000 and corresponding octagonal container 1001 similar in most respect to those in FIGS. 1A and 1B, but for how the first and second wall structures 1016, 1018. The first and second wall panels 1020, 1022 are configured to fold along a first fold line 1042, which can include any suitable combination of scores, perforations, intermittent cuts, or the like, to overlap the first and second wall panels 1020, 1022 with one another to form the first side walls, namely the end walls 1024 of the container 1001 in FIG. 10B. The fold line 1042 directly connects between the first and second wall panels 1020, 1022 of each wall structure 1016, 1018 to form a top edge of the end walls 1024 relative to the base 1002. A second fold line 1043 connects first and second portions 1038, 1040 of each of the stacking tab sections 1032. The second fold line 1043 is spaced apart farther from the base 1002 than is the first fold line 1042 in each wall structure 1016, 1018, so in a container 1001 formed from the blank 1000, the second fold line 1043 forms a top edge of the stacking tabs 1034 formed from the first and second portions 1038, 1040 of the stacking tab sections 1032. In the container 1000 of FIG. 10B, the second fold line 1043 is above the first fold line 1042, relative to the base 1002, i.e. as oriented in FIG. 10B. It can be seen that in container 1001 there are no end tabs such as the end tabs 460 in FIG. 4B.

Figure 11A:
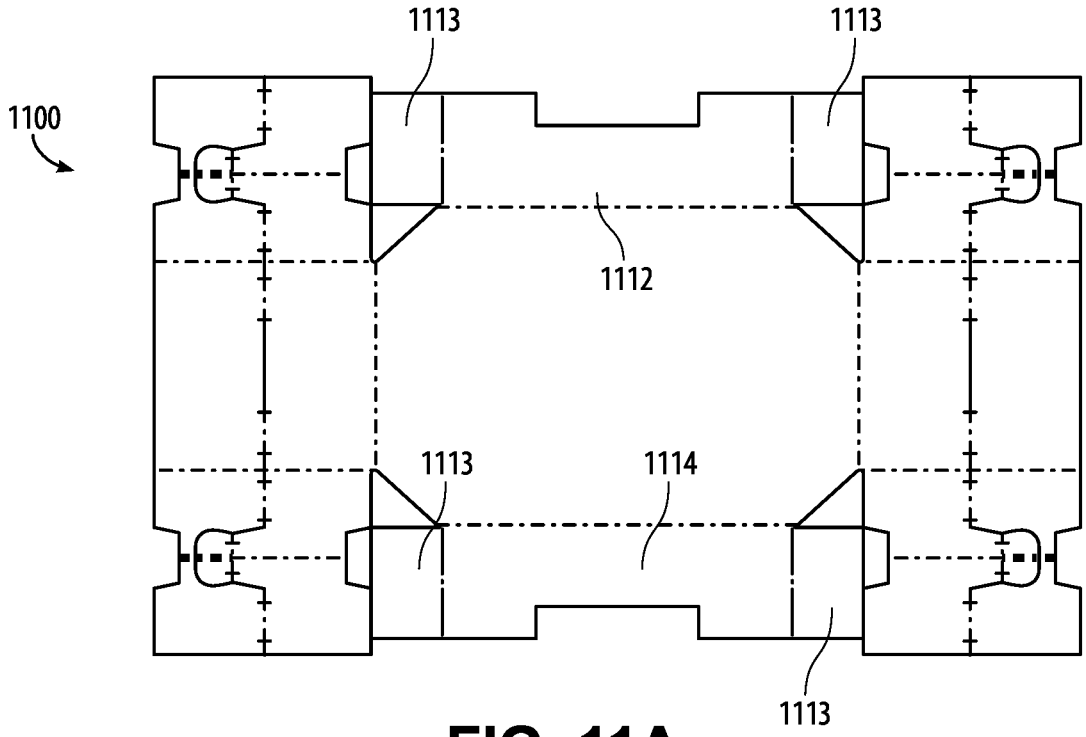
FIG. 11A is a plan view of an embodiment of a blank constructed in accordance with the present disclosure, showing stacking tab portions along corner fold lines.
Figure 11B:
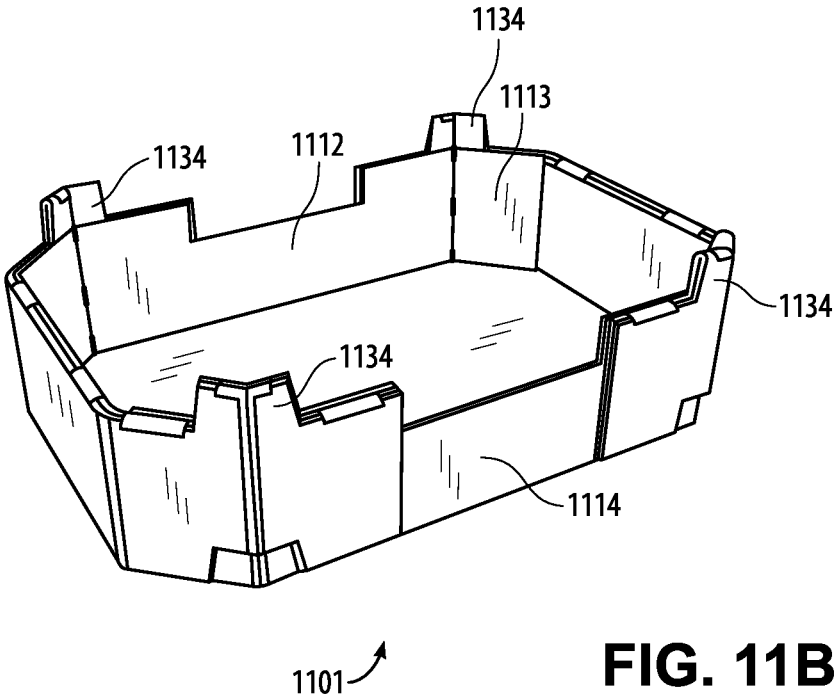
FIG. 11B is a perspective view of a container constructed from the blank of FIG. 11A, showing the stacking tabs formed along the corner fold lines.

With reference now to FIGS. 11A and 11B, there is a blank 1100 and corresponding container 1101 similar to those shown in FIGS. 10A and 10B. However, the stacking tabs 1134 in the container 1101 of FIG. 11B are formed on a corner fold, much as shown and described for FIGS. 3A and 3B. The first and second wall structures 1112, 1114 include an additional corner panel 1113 on each end, which can be optionally omitted as it is in FIGS. 10A and 10B.

Figure 12A:
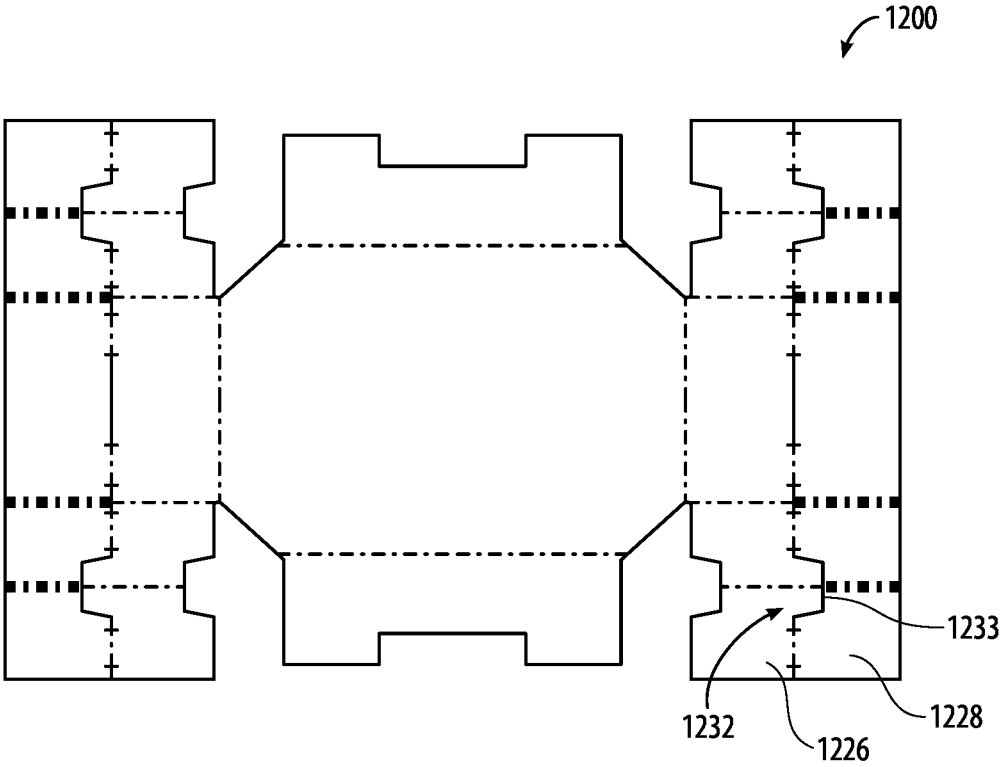
FIG. 12A is a plan view of an embodiment of a blank constructed in accordance with the present disclosure, showing cut top edges of the stacking tab portions.
Figure 12B:
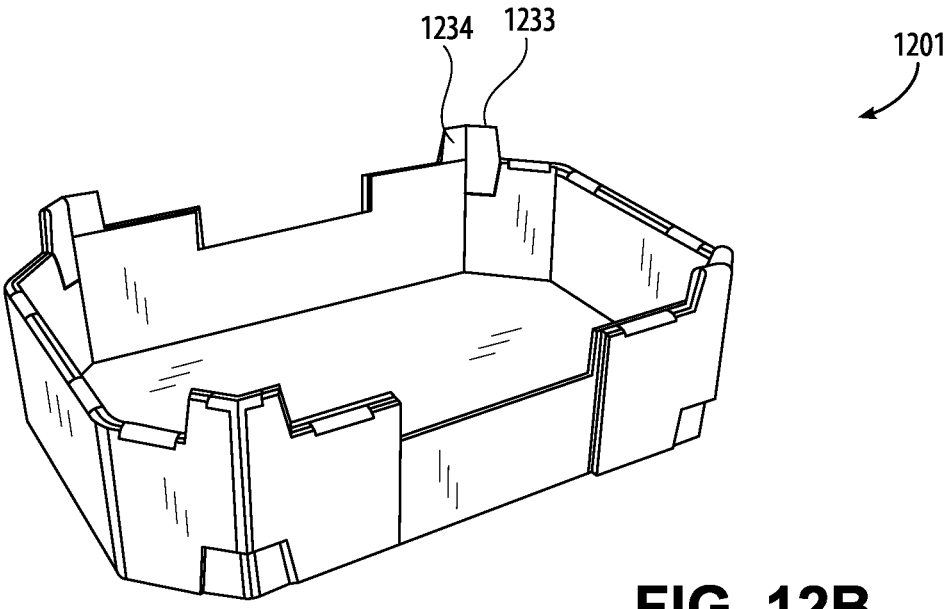
FIG. 12B is a perspective view of a container constructed from the blank of FIG. 12A, showing the stacking tabs with cut top edges.

As shown in FIGS. 12A and 12B, a blank 1200 and corresponding container 1201 are shown similar to those of FIGS. 11A and 11B. However, the stacking tab sections 1232 are each defined by a cut 1233 in the first and second minor end flaps 1226, 1228, so that in the container 1201 formed from the blank 1200, a top edge of each stacking tab 1234 formed of from the stacking tab section 1232 is defined by the cut 1233.

Figure 13A:
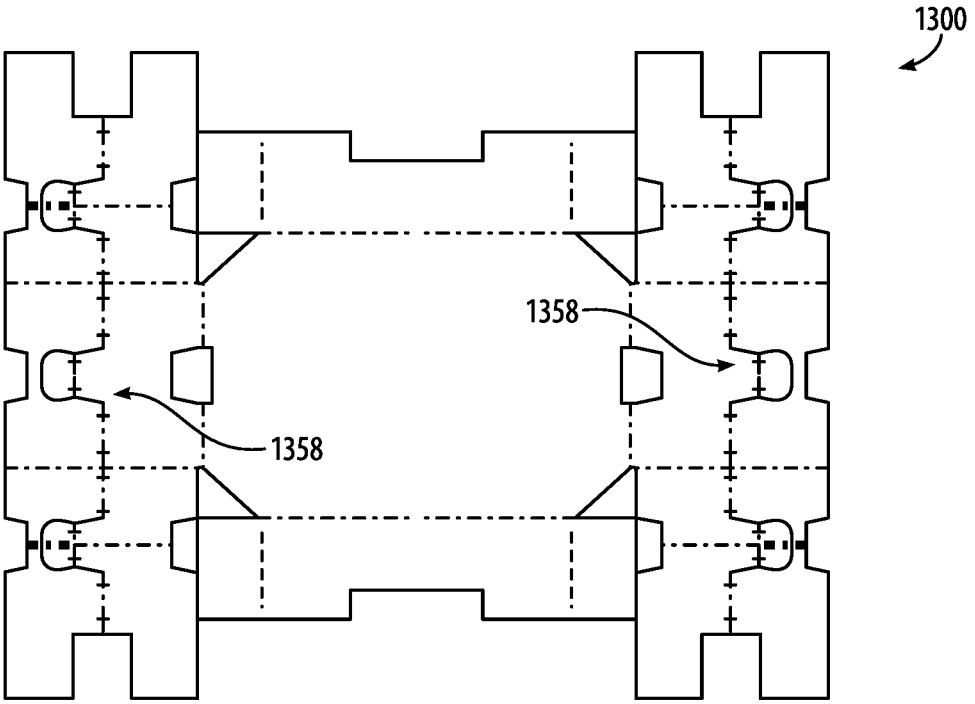
FIG. 13A is a plan view of an embodiment of a blank constructed in accordance with the present disclosure, showing a similar blank to that of FIG. 12A but with additional stacking tab portions for additional end tabs.
Figure 13B:
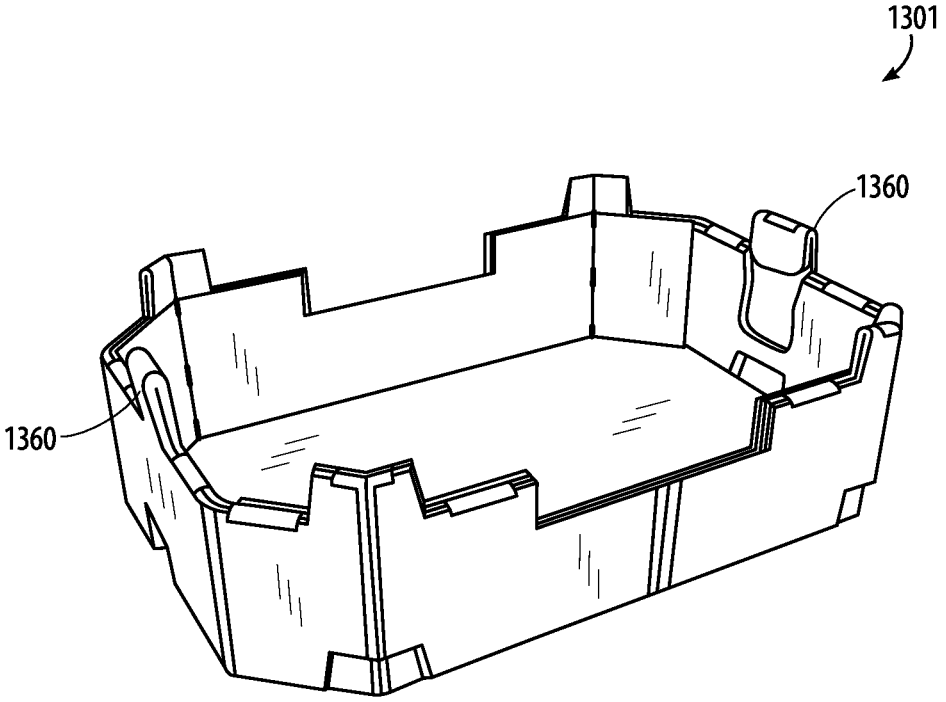
FIG. 13B is a perspective view of a container constructed from the blank of FIG. 13A, showing the additional end tabs.
Figure 14A:
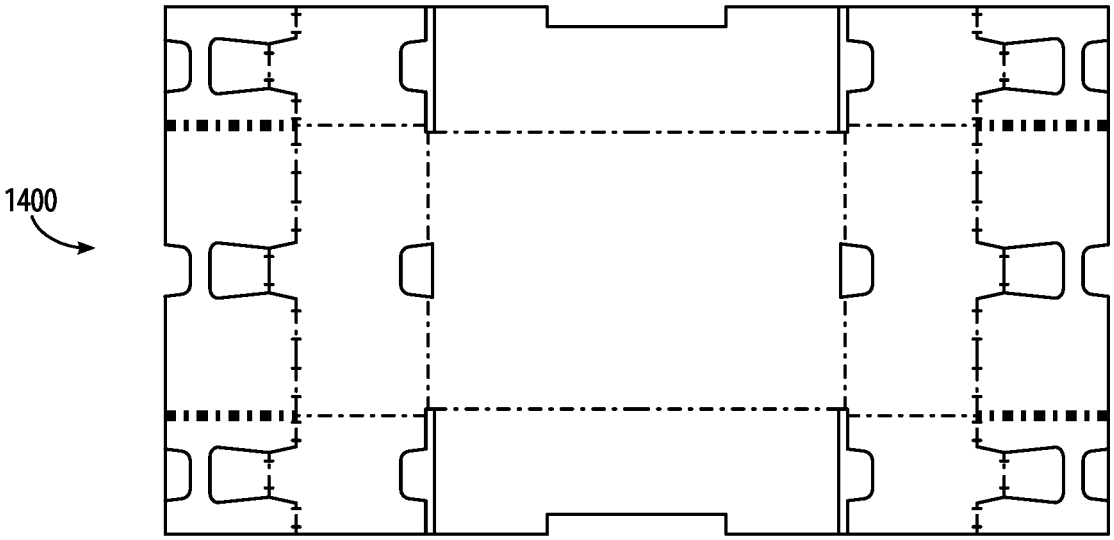
FIG. 14A is a plan view of an embodiment of a blank constructed in accordance with the present disclosure, showing a rectangular version similar to the octagonal blank of FIG. 13A.
Figure 14B:
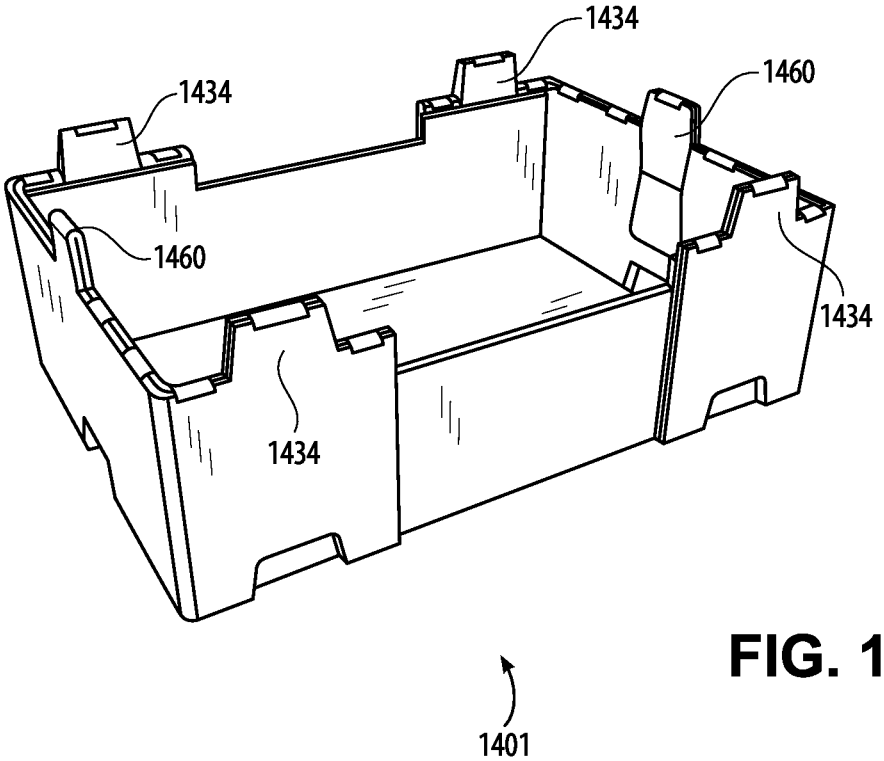
FIG. 14B is a perspective view of a container constructed from the blank of FIG. 14A, showing the rectangular shape of the container.

FIGS. 13A and 13B show a blank 1300 and corresponding container similar to those of FIGS. 11A and 11B, but they include stacking tab portions 1358 for forming end tabs 1360 similar those described above for FIGS. 4A and 4B. FIGS. 14A and 14B show a blank 1400 and corresponding container 1401 with similar stacking tabs 1434 to shows shown in FIG. 10B, similar end tabs 1460 to those shown in FIG. 13B, but in a rectangular configuration, similar to the container 600 FIG. 6B.

Figure 15A:
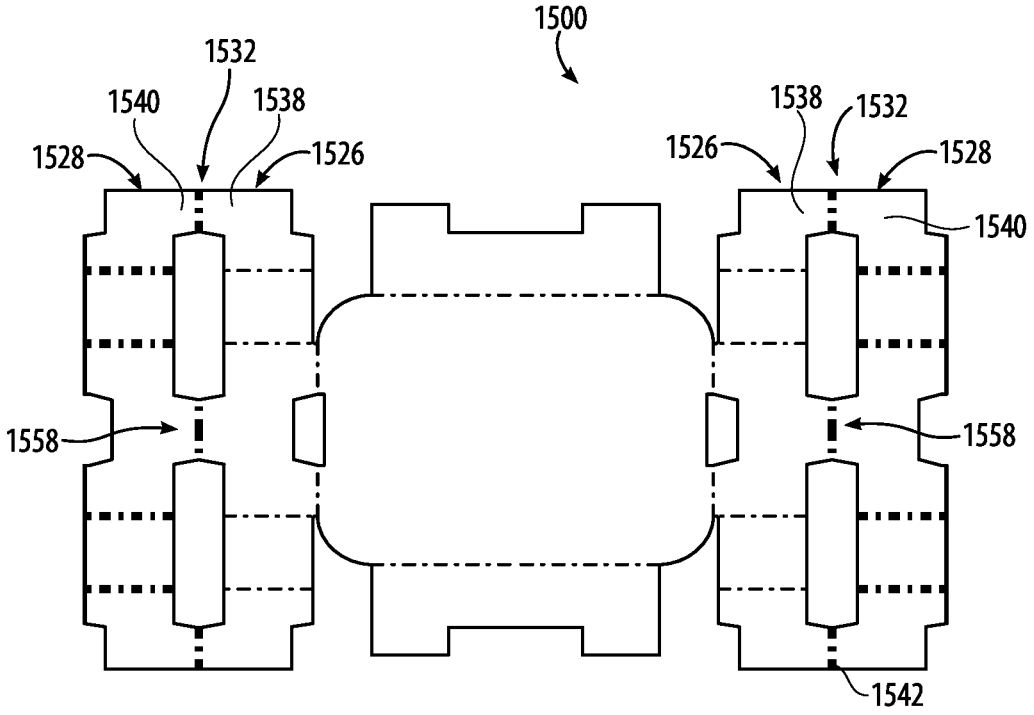
FIG. 15A is a plan view of an embodiment of a blank constructed in accordance with the present disclosure, showing stacking tab portions separated by a cut.
Figure 15B:
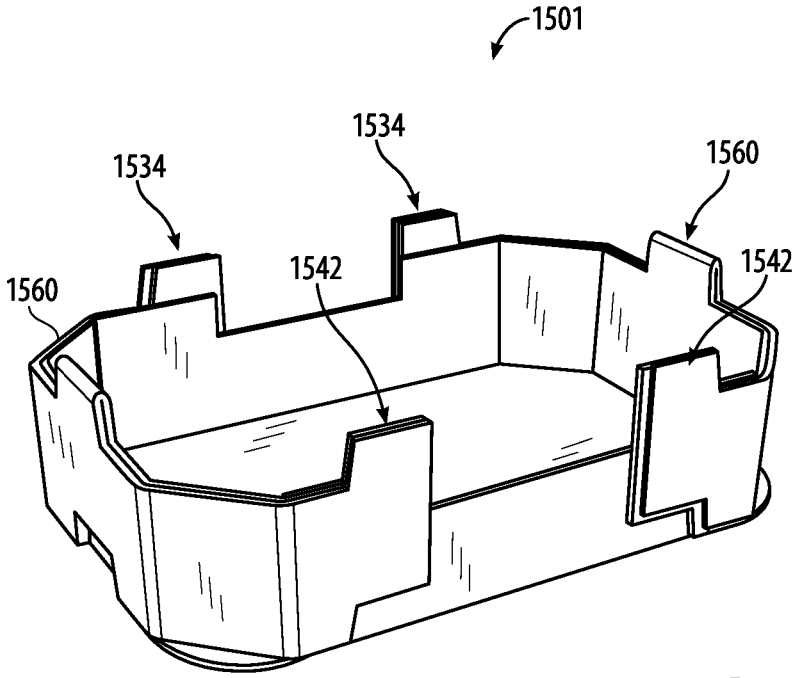
FIG. 15B is a perspective view of a container constructed from the blank of FIG. 15A, showing the end tabs.

In accordance with at least one aspect of this disclosure, with reference now to FIGS. 15A and 15B, a blank 1500 for forming a corresponding container 1501 can be similar to the blank 400 and container 401 as shown and described in FIGS. 4A and 4B. The blank 1500 can include stacking tab section 1532 defined in the first and second minor end flaps 1526, 1528 to form a stacking tab 1534. The first portion 1538 of each stacking tab second 1532 is formed in the respective first minor end flap 1526 and the second portion 1540 of each stacking tab section 1532 is formed in the respective second minor end flap 1528. Unlike blank 400, in blank 1500, a cut 1542 separates the first and second portions of the stacking tab section 1532, so the first and second portions 1538, 1540 of the stacking tab section 1532 can separate to facilitate erecting the container 1501 made from the blank 1500. Accordingly, there is no fold line connecting the respective stacking tab portions 1538, 1540 in the erected container 1501.

Still with reference to FIGS. 15A and 15B, the first and second minor end flaps 1526, 1528 are not long enough meet opposing first and second minor end flaps at the middle of the base 1502 in the container 1501, thus the first stacking tab section 1532 can be configured to form a separate stacking tab 1534 from an opposing stacking tab section 1542 of the opposing first and second minor end flaps 1526, 1528. The blank 1500 can include second stacking tab sections 1558 configured to form a second stacking tab (e.g., end tabs 1560). In blank 1500, the second stacking tab sections 1558 can be connected via fold lines.

Figure 16A:
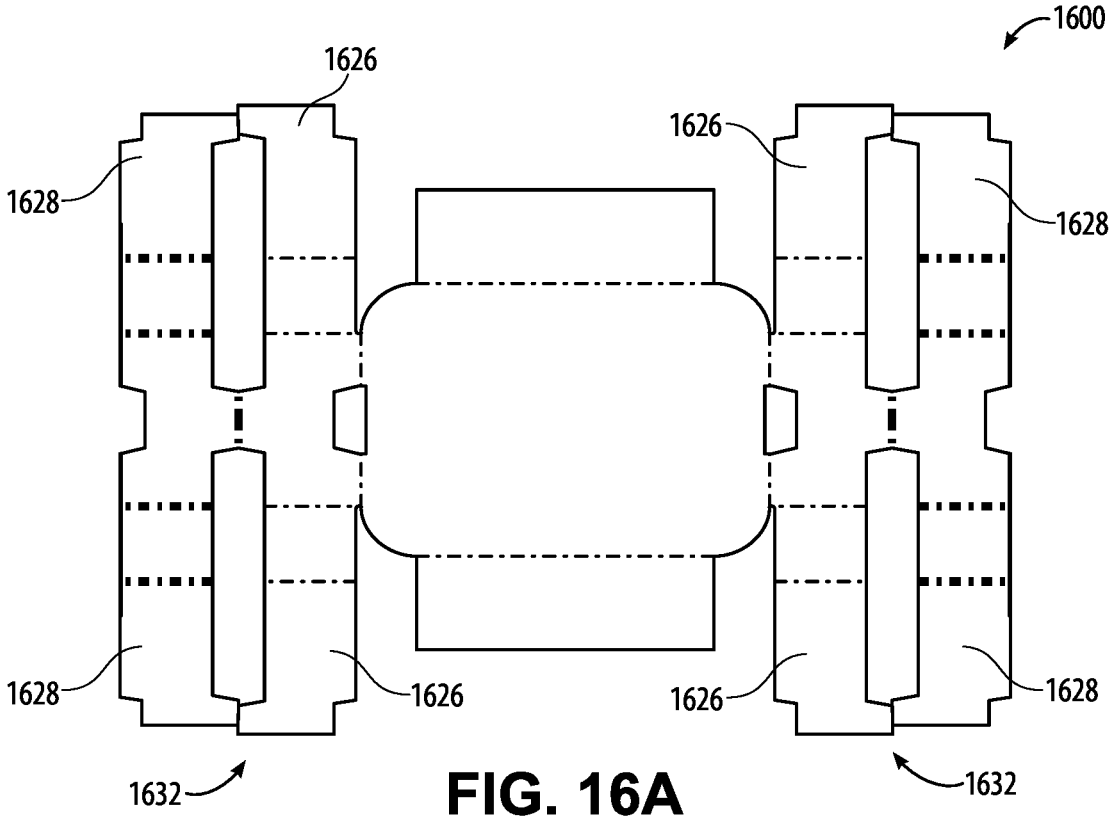
FIG. 16A is a plan view of an embodiment of a blank constructed in accordance with the present disclosure, similar to the blank of FIG. 15A but where the stacking tab portions are long enough to meet at a middle of a base of the container.
Figure 16B:
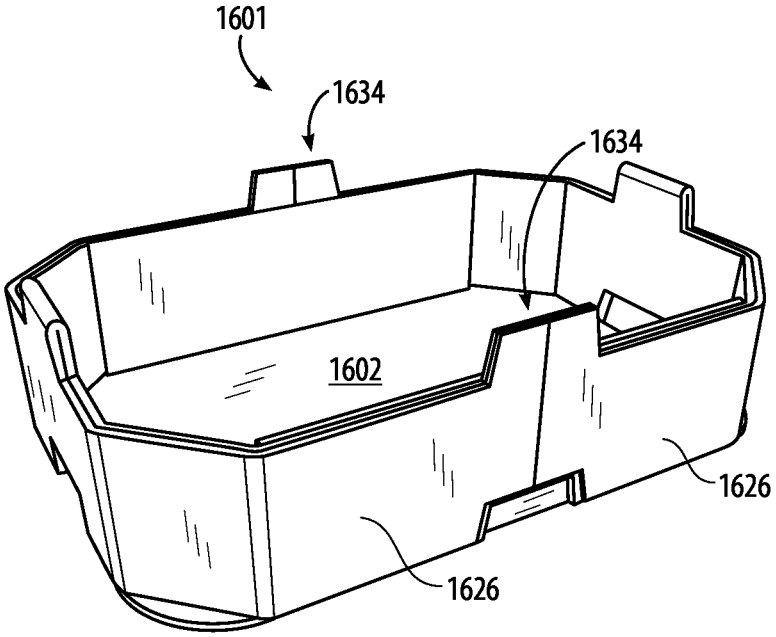
FIG. 16B is a perspective view of a container constructed from the blank of FIG. 16A.

In certain embodiments, such as shown in FIGS. 16A and 16B, a blank 1600 for forming corresponding container 1601 can be similar to that of blank 1500 and container 1501. In blank 1601, the first and second minor end flaps 1626, 1628 can be long enough meet opposing first and second minor end flaps at a middle of the base 1602 in the container 1601 formed from the blank 1600. Here, the first stacking tab section 1632 can be configured to form a single stacking tab 1634 in cooperation with an opposing stacking tab section 1632 of the opposing first and second minor end flaps 1626, 1628.

Figure 17A:
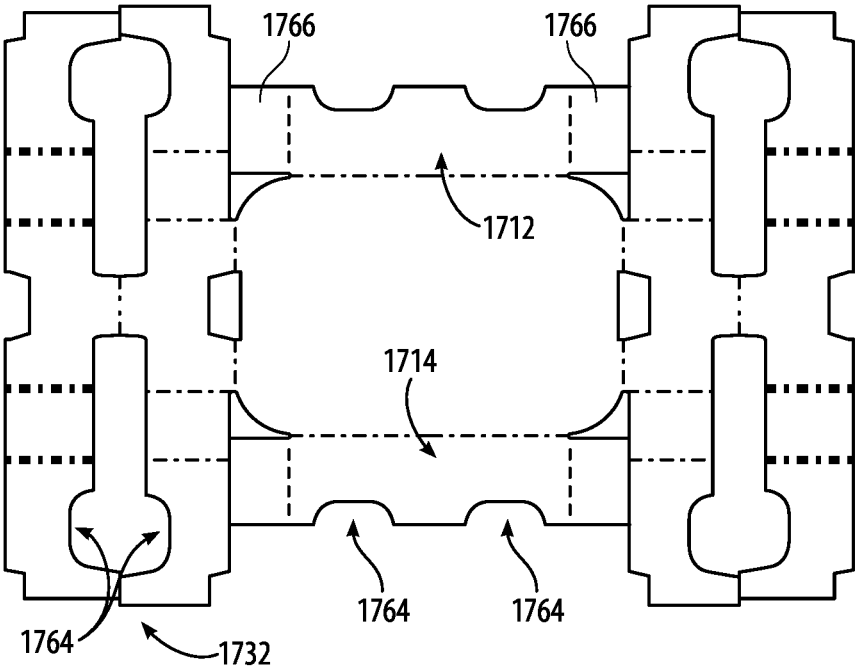
FIG. 17A is a plan view of an embodiment of a blank constructed in accordance with the present disclosure, similar to the blank of FIG. 16A but having U shaped features in one or more of the side walls and/or the stacking tab portions.
Figure 17B:
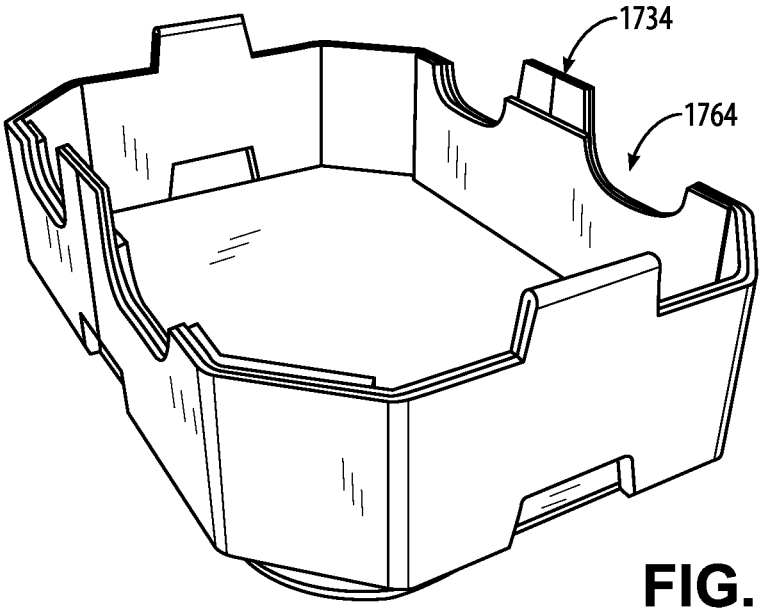
FIG. 17B is a perspective view of a container constructed from the blank of FIG. 17A.

In certain embodiments, with reference now to FIGS. 17A and 17B a blank 1701 for forming container 1701 can be similar to that of blank 1601 except that the respective wall structures 1712, 1714 and the stacking tab sections 1732 can each include one or more U shaped features 1764 defined therein. The U shaped 1764 features of the walls structures 1712, 1714 can correspond to the U shaped features 1764 of the respective stacking tab sections 1732 in the formed container 1701. In certain embodiments, the innermost flaps 1766 of the respective wall structures 1712, 1714 can be omitted.

Figure 18A:
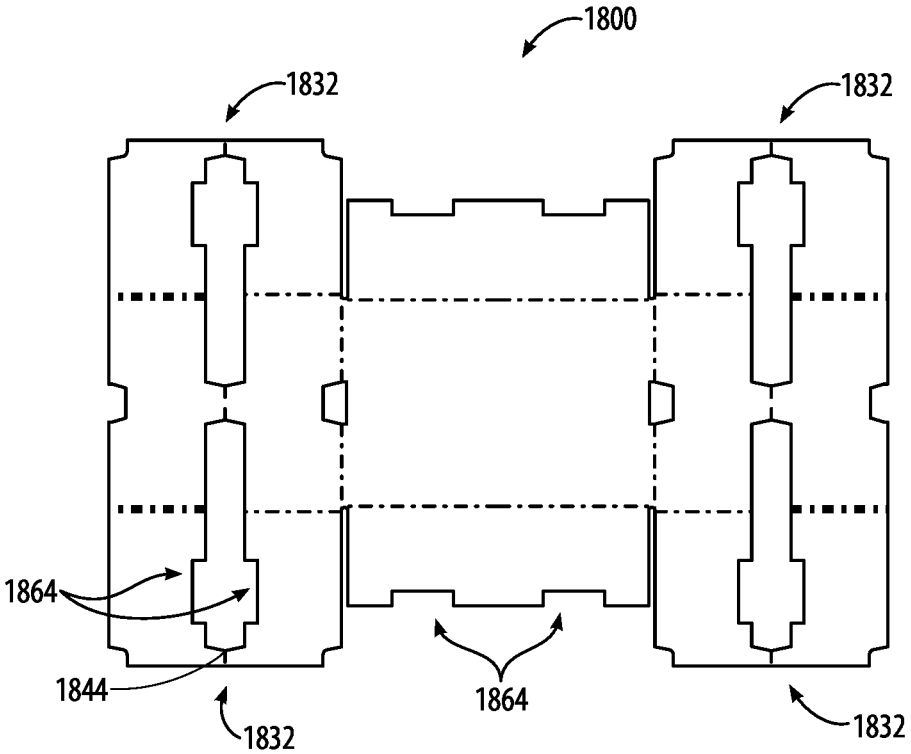
FIG. 18A is a plan view of an embodiment of a blank constructed in accordance with the present disclosure, similar to the blank of FIG. 17A but being configured to form a rectangular container.
Figure 18B:
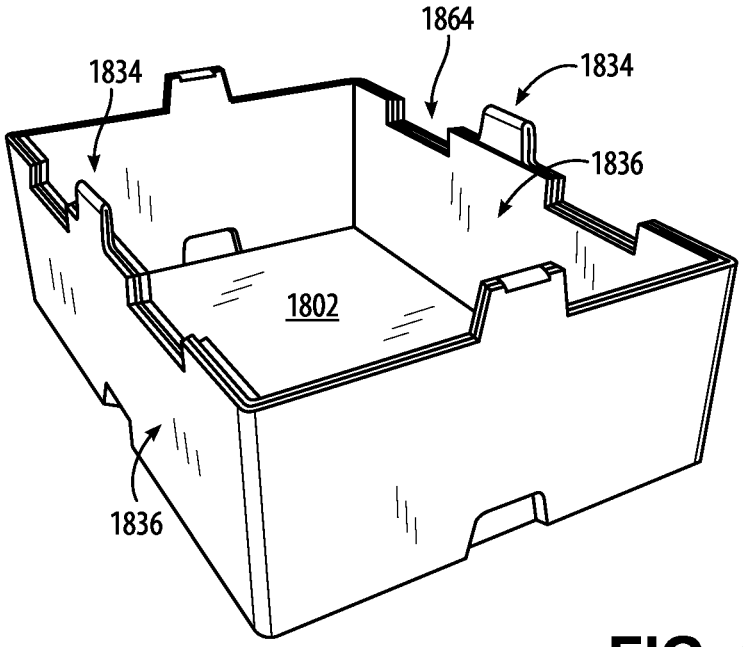
FIG. 18B is a perspective view of a container constructed from the blank of FIG. 18A.

In certain embodiments, with reference now to FIGS. 18A and 18B, a blank 1800 for forming corresponding container 1801 can be similar to the blank 1700 and container 1701 as shown in FIGS. 17A and 17B. However, in blank 1800 the corresponding container 1801 formed can be rectangular and the U shaped features 1864 can also be rectangular. The beveled edges can be omitted to form the rectangular container 1801 similar to that of container 601 shown and described with respect to FIGS. 6A and 6B. The stacking tab sections 1834 can have either a fold line (e.g., as shown in the container 1801) or a cut 1844 (e.g., as shown in the blank 1800).

Figure 19A:
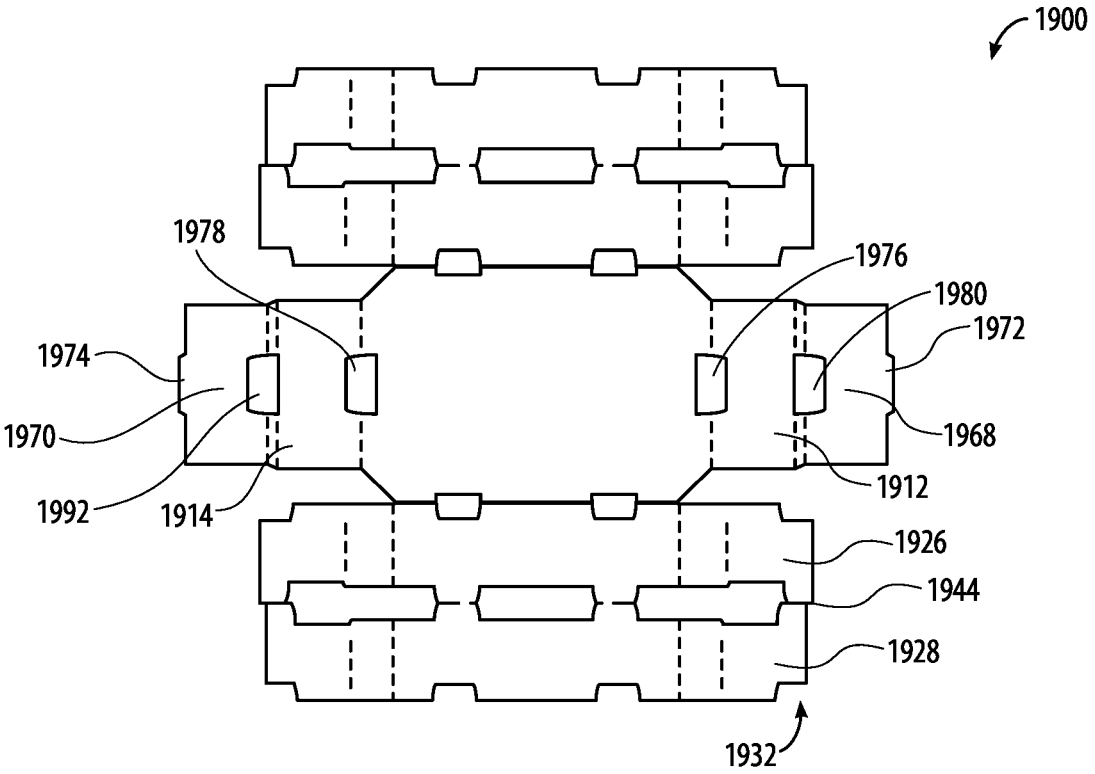
FIG. 19A is a plan view of an embodiment of a blank constructed in accordance with the present disclosure, similar to the blank of FIG. 5A, showing stacking tab portions as end tabs, the stacking tab portions separated by a cut and having an additional panel on each sidewall structure for forming the container by hand assembly.
Figure 19B:
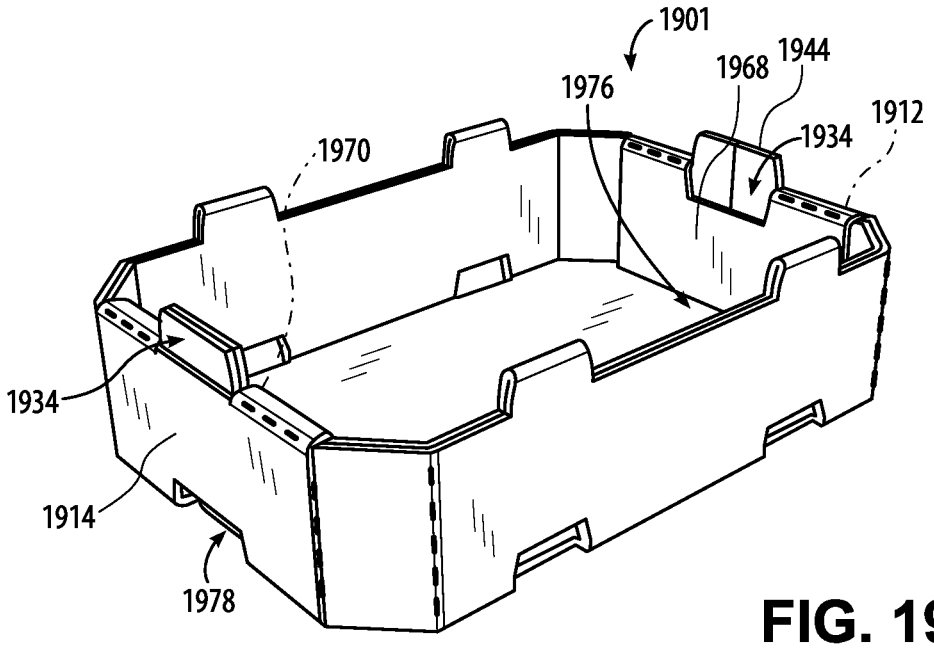
FIG. 19B is a perspective view of a container constructed from a blank of FIG. 19A.
Figure 20A:
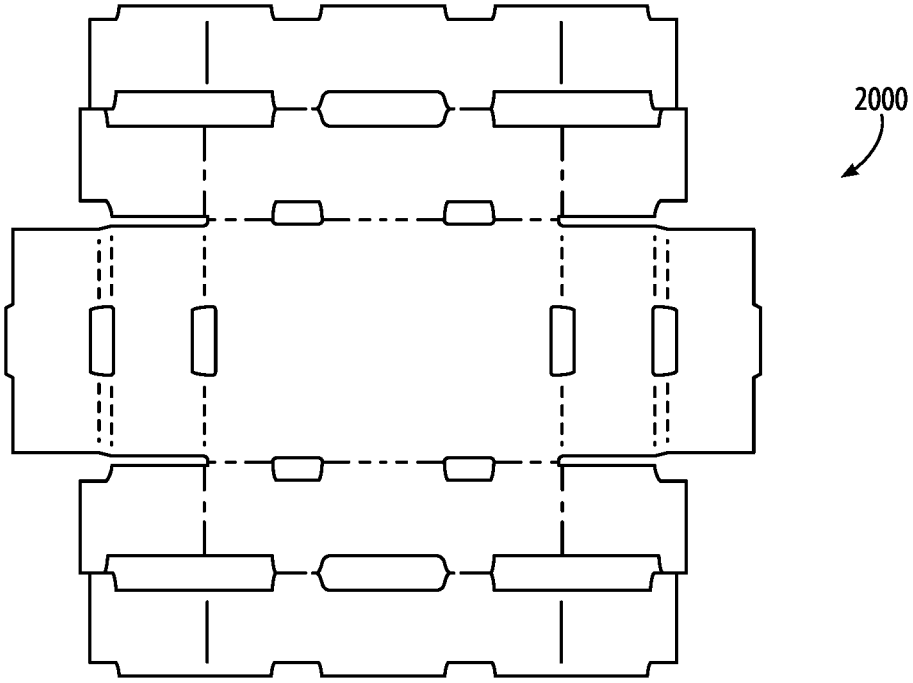
FIG. 20A is a plan view of an embodiment of a blank constructed in accordance with the present disclosure, similar to the blank of FIG. 19A but being configured to form a rectangular container.
Figure 20B:
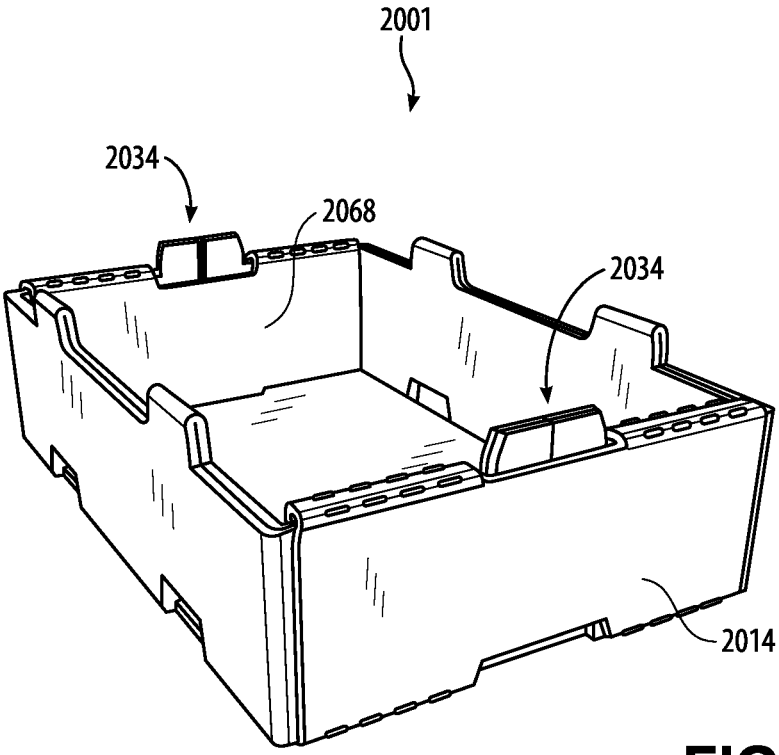
FIG. 20B is a perspective view of a container constructed from a blank of FIG. 20A.
Figure 21A:
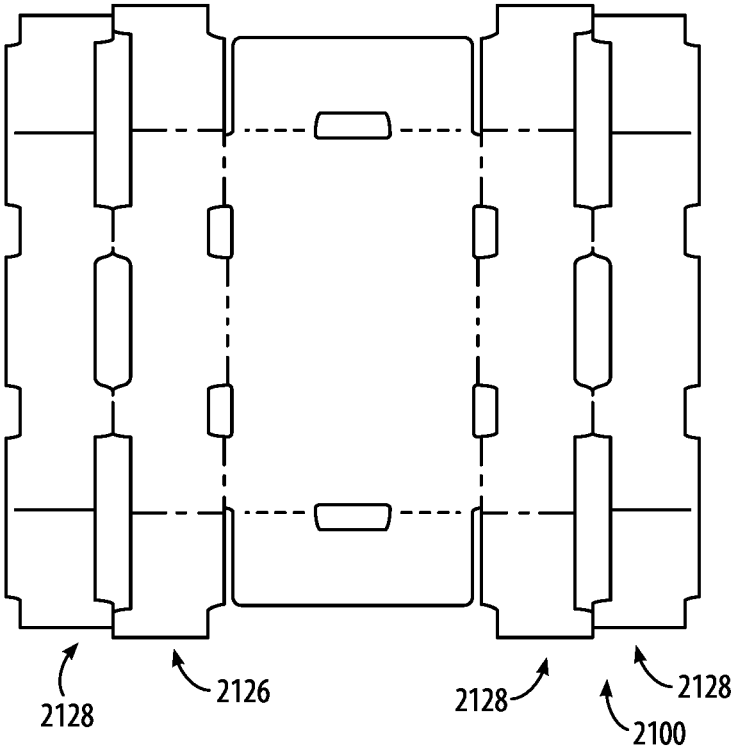
FIG. 21A is a plan view of an embodiment of a blank constructed in accordance with the present disclosure, similar to the blank of FIG. 19A but without the additional panel on the sidewall structure, and further being configured to form a rectangular container.

With reference now to FIGS. 19A and 19B, the blank 1900 and container 1901 can be similar to blank 500 and container 501 shown in FIGS. 5A and 5B. In container 1901, the stacking tabs 2034 formed in the respective side walls 2012, 2014 have a cut 2044 separating the respective stacking tab portions 2026, 2028, instead of a fold line. In addition, to aid in erecting the container 1901 by hand, the sidewall structures 1912, 1914 can have an additional panel 1968, 1970 configured to fold over the sidewall structure, locking the sidewall structures 1912, 1914 in place with a respective locking tab 1972, 1974 inserted into slots 1976, 1978. When erecting the container 1901 from blank 1900, the sidewall structures 1912, 1914 can be folded upward, then the end walls and stacking tab sections 1932 are folded up and stacking tab sections 1932 are folded around sidewall structures 1912, 1914. The additional panels 1968, 1970 are folded overtop of the stacking tab sections 1932 and the stacking tabs 1934 extend through a slot 1980, 1982 while locking tabs 1972, 1974 are inserted into slots 1976, 1978, holding the container 1901 in the erected state without any adhesive. This allows for in the field construction of the container 1901 by hand and without machine assistance. FIGS. 21A and 20B show a blank 2000 for forming container 2001 which can be similar to the blank 1900 and container 1901, but blank 2000 can be designed to form a rectangular container 2001, whereas container 1901 is octagonal.

Figure 21B:
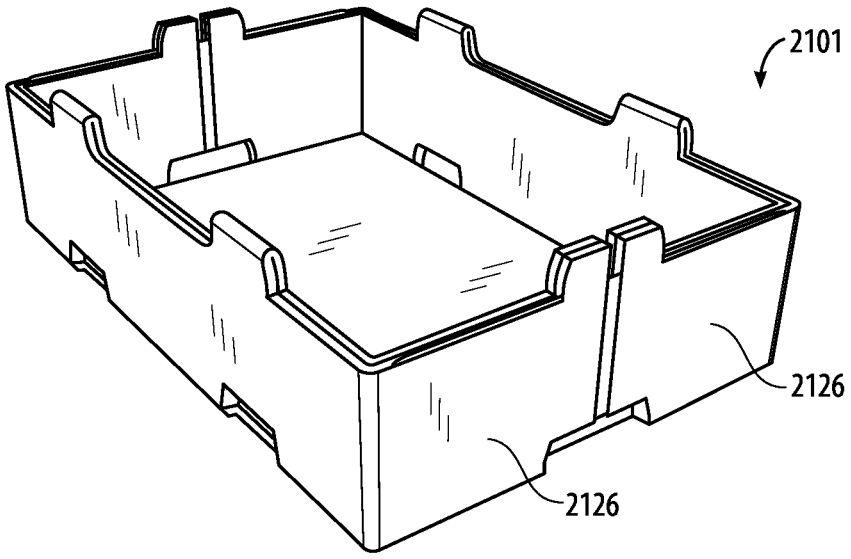
FIG. 21B is a perspective view of a container constructed from the blank of FIG. 21A.

With reference now to FIGS. 21A-21B, a blank 2100 for forming corresponding container 2101 can be similar to that of blank 2000 and container 2001 except that the blank 2100 can omit the additional sidewall panels 2068, 2070. The respective stacking tab portions 2126, 2128 can be shorter than in blank 2000 such that when in the formed container 2100, a larger gap between the opposed stacking tab portions 2126 is formed than in container 2000.

One having ordinary skill in the art, in view of this disclosure, would readily appreciate that one or more embodiments of the blanks and containers shown and described herein can have a folding sequence such that the first side wall structures can be positioned inward from the first and second wall panels in the erected container (e.g., as shown in at least FIGS. 15A-16B), or such that sidewall structures can be positioned between first and second minor end flaps of the second sidewall structures in the erected container. In embodiments, the formed containers can have minor end flaps positioned as the inner most panel of the formed container (e.g., as shown in at least FIGS. 17A-18B), or in embodiments, the minor end flaps can be positioned between respective stacking tab portions (e.g., as shown in at least FIGS. 21A-21B).

The methods and systems of the present disclosure, as described above and shown in the drawings, provide for stackable containers with stacking tabs for containing product such as produce. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for forming a container comprising:

a base having a first pair of opposed base edges and a second pair of opposed base edges;

two first side wall structures, each first side wall structure foldably attached to one of the first base edges; and two second side wall structures, each second side wall structure foldably attached to one of the second base edges, wherein each of the second side wall structures comprises:

a first wall panel foldably attached to one of the second base edges along a first fold line, a second wall panel foldably attached to the first wall panel configured to be overlapped with the first wall panel to form a side wall, and a first minor end flap foldably attached to the first wall panel extending in a lateral direction from the first side wall panel, and a second minor end flap foldably attached to the second side wall panel extending in the lateral direction from the second side wall panel, configured to overlap the first minor end flap and one of the first side wall structures in forming a corner of a container formed from the blank, wherein a stacking tab section is defined in the first and second minor end flaps that is configured to form a stacking tab extending upright from a first side wall of the container formed from the blank with the first and second minor end flaps overlapped with one of the side wall structures to form the first side wall, wherein a first portion of the stacking tab section is formed in the first minor end flap, wherein a second portion of the stacking tab section is formed in the second minor end flap, and wherein a fold line connects the first and second portions of the stacking tab section, wherein the first and second wall panels are configured to fold along the fold line to overlap the first and second wall panels with one another to form the first wall panel to form a side wall.

2. The blank as recited in claim 1, wherein the first and second wall panels are configured to form a first end wall adjacent to the first side wall with the corner of the container connecting between the first end wall and the first side wall.

3. The blank as recited in claim 2, wherein the second side wall structures are configured so that there is no stacking tab extending upward from the first end wall in the container formed from the blank.

4. The blank as recited in claim 3, wherein the first minor end flap includes a first corner panel, wherein the second minor end flap includes a second corner panel, wherein the first and second corner panels are configured to overlap and form a beveled wall connecting the first end wall to the first side wall in the container formed from the blank.

5. The blank as recited in claim 4, wherein a portion of the stacking tab section is formed in the first and second wall panels, so in the container formed from the blank the stacking tab section forms a stacking tab extending along both sides of a fold line connecting the first sidewall and the first end wall.

6. The blank as recited in claim 1, wherein a void separates the first and second wall panels so that in the container formed from the blank, the fold line is on a top edge of the stacking tab formed from the stacking tab section, relative to the base.

7. The blank as recited in claim 6, wherein the second side wall structures are configured so that there is no stacking tab extending upward from the first end wall in the container formed from the blank.

8. The blank as recited in claim 7, wherein the first minor end flap includes a first corner panel, wherein the second minor end flap includes a second corner panel, wherein the first and second corner panels are configured to overlap and form a beveled wall connecting the first end wall to the first side wall in the container formed from the blank.

9. The blank as recited in claim 8, wherein a portion of the stacking tab section is formed in the first and second wall panels, so in the container formed from the blank the stacking tab section forms a stacking tab extending along both sides of a fold line connecting the first sidewall and the first end wall.

10. The blank as recited in claim 7, wherein the first minor end flap is foldably connected directly to the first wall panel, and wherein the second minor end flap is foldably connected directly to the second wall panel so that in the container formed from the blank, the first end wall is foldably connected directly to the first side wall without an intervening bevel panel.

11. The blank as recited in claim 6 wherein edges of the void form top edges of the first end wall and of the first side wall below the top edge of the stacking tab, relative to the base.

12. The blank as recited in claim 1, wherein the stacking tab section is a first stacking tab section and further comprising:

a second stacking tab section defined in the first and second wall panels, configured to form a stacking tab extending upright from a first end wall of the container formed from the blank with the corner of the container connecting between the first end wall and the first side wall.

13. The blank as recited in claim 12, wherein the first and second stacking tab portions each fold along a fold line, wherein the fold line is interrupted between the first and second stacking tab portions by a void separating between the first and second wall panels, so that in the container formed from the blank, the fold line is on a top edge of the stacking tabs formed of the first and second stacking tab sections, relative to the base, and wherein edges of the void form top edges of the first end wall and of the first side wall below the top edges of the stacking tabs, relative to the base.

14. The blank as recited in claim 13, wherein the first minor end flap includes a first corner panel, wherein the second minor end flap includes a second corner panel, wherein the first and second corner panels are configured to overlap and form a beveled wall connecting the first end wall to the first side wall in the container formed from the blank.

15. The blank as recited in claim 13, wherein the first minor end flap is foldably connected directly to the first wall panel, and wherein the second minor end flap is foldably connected directly to the second wall panel so that in the container formed from the blank, the first end wall is foldably connected directly to the first side wall without an intervening bevel panel.

16. The blank as recited in claim 1, wherein the first and second wall panels are configured to fold along a first fold line to overlap the first and second wall panels with one another to form the first wall panel to form a side wall, wherein the first fold line directly connects between the first and second wall panels to form a top edge of the side wall relative to the base in the container formed from the blank.

17. The blank as recited in claim 16, wherein a second fold line connects first and second portions of the stacking tab section, wherein the second fold line is spaced apart farther from the base than the first fold line, so in a container formed from the blank, the second fold line forms a top edge of a stacking tab formed from the first and second portion of the stacking tab section, wherein the second fold line is above the first fold line, relative to the base.

18. A container made from a blank as recited in claim 1, wherein each of the first side wall structures is positioned inward from the first and second wall panels.

19. A container made from a blank as recited in claim 1, wherein each of the first side wall structures is positioned outward from the first and second wall panels.

20. A container made from a blank as recited in claim 1, wherein each of the first sidewall structures is positioned inward of first minor end flaps of the second sidewall structures and outward of second minor end flaps of the second sidewall structures.

* * * * *